US011043178B2

(12) United States Patent
Takahashi

(10) Patent No.: US 11,043,178 B2
(45) Date of Patent: Jun. 22, 2021

(54) ELECTRO-OPTICAL DEVICE, DRIVING METHOD FOR ELECTRO-OPTICAL DEVICE, AND ELECTRONIC APPARATUS

(71) Applicant: SEIKO EPSON CORPORATION, Tokyo (JP)

(72) Inventor: Nariya Takahashi, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/554,760

(22) Filed: Aug. 29, 2019

(65) Prior Publication Data

US 2020/0074953 A1 Mar. 5, 2020

(30) Foreign Application Priority Data

Aug. 30, 2018 (JP) ..... JP2018-161122

(51) Int. Cl.
*G09G 3/36* (2006.01)

(52) U.S. Cl.
CPC ... *G09G 3/3677* (2013.01); *G09G 2310/0205* (2013.01); *G09G 2310/0213* (2013.01); *G09G 2320/0252* (2013.01); *G09G 2320/0271* (2013.01)

(58) Field of Classification Search
None
See application file for complete search history.

(56) References Cited

U.S. PATENT DOCUMENTS

2013/0076707 A1 3/2013 Tokumura et al.
2015/0154926 A1* 6/2015 Fujikawa ..... G09G 3/3688 345/204

FOREIGN PATENT DOCUMENTS

JP 2012-150496 A 8/2012
JP 2015-072328 A 4/2015
JP 2015-106108 A 6/2015
JP 5799709 B2 10/2015

* cited by examiner

*Primary Examiner* — Aneeta Yodichkas
(74) *Attorney, Agent, or Firm* — Oliff PLC

(57) ABSTRACT

The selection signal output circuit outputs a selection signal for simultaneously selecting a set of switches, which correspond to a set of adjacent signal lines, among k switches in a partial period obtained by time-dividing a horizontal scanning period, and outputs a selection signal for selecting remaining switches among the k switches one at a time in a remaining period of the time-divided horizontal scanning period, and the image signal output circuit supplies a same image signal to a set of adjacent signal lines corresponding to the simultaneously selected set of switches in a partial period obtained by time-dividing the horizontal scanning period.

13 Claims, 26 Drawing Sheets

FIRST FRAME PERIOD
(FIRST VERTICAL SCANNING PERIOD V1)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 140 | 160 | 180 | 200 | 200 |
| SECOND HORIZONTAL SCANNING PERIOD: H2 | G2 | 80 | 100 | 120 | 140 | 160 | 180 | 200 | 200 |
| THIRD HORIZONTAL SCANNING PERIOD: H3 | G3 | 80 | 100 | 120 | 140 | 160 | 180 | 200 | 200 |
| FOURTH HORIZONTAL SCANNING PERIOD: H4 | G4 | 80 | 100 | 120 | 140 | 160 | 180 | 200 | 200 |
| FIFTH HORIZONTAL SCANNING PERIOD: H5 | G5 | 80 | 100 | 120 | 140 | 160 | 180 | 200 | 200 |
| SIXTH HORIZONTAL SCANNING PERIOD: H6 | G6 | 80 | 100 | 120 | 140 | 160 | 180 | 200 | 200 |
| SEVENTH HORIZONTAL SCANNING PERIOD: H7 | G7 | 80 | 100 | 120 | 140 | 160 | 180 | 200 | 200 |
| EIGHTH HORIZONTAL SCANNING PERIOD: H8 | G8 | 80 | 100 | 120 | 140 | 160 | 180 | 200 | 200 |

FIG. 6A

SECOND FRAME PERIOD
(SECOND VERTICAL SCANNING PERIOD V2)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 140 | 160 | 180 | 180 | 220 |
| SECOND HORIZONTAL SCANNING PERIOD: H2 | G2 | 80 | 100 | 120 | 140 | 160 | 180 | 180 | 220 |
| THIRD HORIZONTAL SCANNING PERIOD: H3 | G3 | 80 | 100 | 120 | 140 | 160 | 180 | 180 | 220 |
| FOURTH HORIZONTAL SCANNING PERIOD: H4 | G4 | 80 | 100 | 120 | 140 | 160 | 180 | 180 | 220 |
| FIFTH HORIZONTAL SCANNING PERIOD: H5 | G5 | 80 | 100 | 120 | 140 | 160 | 180 | 180 | 220 |
| SIXTH HORIZONTAL SCANNING PERIOD: H6 | G6 | 80 | 100 | 120 | 140 | 160 | 180 | 180 | 220 |
| SEVENTH HORIZONTAL SCANNING PERIOD: H7 | G7 | 80 | 100 | 120 | 140 | 160 | 180 | 180 | 220 |
| EIGHTH HORIZONTAL SCANNING PERIOD: H8 | G8 | 80 | 100 | 120 | 140 | 160 | 180 | 180 | 220 |

FIG. 6B

THIRD FRAME PERIOD
(THIRD VERTICAL SCANNING PERIOD V3)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 140 | 160 | 160 | 200 | 220 |
| SECOND HORIZONTAL SCANNING PERIOD: H2 | G2 | 80 | 100 | 120 | 140 | 160 | 160 | 200 | 220 |
| THIRD HORIZONTAL SCANNING PERIOD: H3 | G3 | 80 | 100 | 120 | 140 | 160 | 160 | 200 | 220 |
| FOURTH HORIZONTAL SCANNING PERIOD: H4 | G4 | 80 | 100 | 120 | 140 | 160 | 160 | 200 | 220 |
| FIFTH HORIZONTAL SCANNING PERIOD: H5 | G5 | 80 | 100 | 120 | 140 | 160 | 160 | 200 | 220 |
| SIXTH HORIZONTAL SCANNING PERIOD: H6 | G6 | 80 | 100 | 120 | 140 | 160 | 160 | 200 | 220 |
| SEVENTH HORIZONTAL SCANNING PERIOD: H7 | G7 | 80 | 100 | 120 | 140 | 160 | 160 | 200 | 220 |
| EIGHTH HORIZONTAL SCANNING PERIOD: H8 | G8 | 80 | 100 | 120 | 140 | 160 | 160 | 200 | 220 |

FIG. 6C

FOURTH FRAME PERIOD
(FOURTH VERTICAL SCANNING PERIOD V4)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 140 | 140 | 180 | 200 | 220 |
| SECOND HORIZONTAL SCANNING PERIOD: H2 | G2 | 80 | 100 | 120 | 140 | 140 | 180 | 200 | 220 |
| THIRD HORIZONTAL SCANNING PERIOD: H3 | G3 | 80 | 100 | 120 | 140 | 140 | 180 | 200 | 220 |
| FOURTH HORIZONTAL SCANNING PERIOD: H4 | G4 | 80 | 100 | 120 | 140 | 140 | 180 | 200 | 220 |
| FIFTH HORIZONTAL SCANNING PERIOD: H5 | G5 | 80 | 100 | 120 | 140 | 140 | 180 | 200 | 220 |
| SIXTH HORIZONTAL SCANNING PERIOD: H6 | G6 | 80 | 100 | 120 | 140 | 140 | 180 | 200 | 220 |
| SEVENTH HORIZONTAL SCANNING PERIOD: H7 | G7 | 80 | 100 | 120 | 140 | 140 | 180 | 200 | 220 |
| EIGHTH HORIZONTAL SCANNING PERIOD: H8 | G8 | 80 | 100 | 120 | 140 | 140 | 180 | 200 | 220 |

FIG. 6D

FIFTH FRAME PERIOD
(FIFTH VERTICAL SCANNING PERIOD V5)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 120 | 160 | 180 | 200 | 220 |
| SECOND HORIZONTAL SCANNING PERIOD: H2 | G2 | 80 | 100 | 120 | 120 | 160 | 180 | 200 | 220 |
| THIRD HORIZONTAL SCANNING PERIOD: H3 | G3 | 80 | 100 | 120 | 120 | 160 | 180 | 200 | 220 |
| FOURTH HORIZONTAL SCANNING PERIOD: H4 | G4 | 80 | 100 | 120 | 120 | 160 | 180 | 200 | 220 |
| FIFTH HORIZONTAL SCANNING PERIOD: H5 | G5 | 80 | 100 | 120 | 120 | 160 | 180 | 200 | 220 |
| SIXTH HORIZONTAL SCANNING PERIOD: H6 | G6 | 80 | 100 | 120 | 120 | 160 | 180 | 200 | 220 |
| SEVENTH HORIZONTAL SCANNING PERIOD: H7 | G7 | 80 | 100 | 120 | 120 | 160 | 180 | 200 | 220 |
| EIGHTH HORIZONTAL SCANNING PERIOD: H8 | G8 | 80 | 100 | 120 | 120 | 160 | 180 | 200 | 220 |

FIG. 6E

SIXTH FRAME PERIOD
(SIXTH VERTICAL SCANNING PERIOD V6)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 100 | 140 | 160 | 180 | 200 | 220 |
| SECOND HORIZONTAL SCANNING PERIOD: H2 | G2 | 80 | 100 | 100 | 140 | 160 | 180 | 200 | 220 |
| THIRD HORIZONTAL SCANNING PERIOD: H3 | G3 | 80 | 100 | 100 | 140 | 160 | 180 | 200 | 220 |
| FOURTH HORIZONTAL SCANNING PERIOD: H4 | G4 | 80 | 100 | 100 | 140 | 160 | 180 | 200 | 220 |
| FIFTH HORIZONTAL SCANNING PERIOD: H5 | G5 | 80 | 100 | 100 | 140 | 160 | 180 | 200 | 220 |
| SIXTH HORIZONTAL SCANNING PERIOD: H6 | G6 | 80 | 100 | 100 | 140 | 160 | 180 | 200 | 220 |
| SEVENTH HORIZONTAL SCANNING PERIOD: H7 | G7 | 80 | 100 | 100 | 140 | 160 | 180 | 200 | 220 |
| EIGHTH HORIZONTAL SCANNING PERIOD: H8 | G8 | 80 | 100 | 100 | 140 | 160 | 180 | 200 | 220 |

FIG. 6F

SEVENTH FRAME PERIOD
(SEVENTH VERTICAL SCANNING PERIOD V7)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 80 | 120 | 140 | 160 | 180 | 200 | 220 |
| SECOND HORIZONTAL SCANNING PERIOD: H2 | G2 | 80 | 80 | 120 | 140 | 160 | 180 | 200 | 220 |
| THIRD HORIZONTAL SCANNING PERIOD: H3 | G3 | 80 | 80 | 120 | 140 | 160 | 180 | 200 | 220 |
| FOURTH HORIZONTAL SCANNING PERIOD: H4 | G4 | 80 | 80 | 120 | 140 | 160 | 180 | 200 | 220 |
| FIFTH HORIZONTAL SCANNING PERIOD: H5 | G5 | 80 | 80 | 120 | 140 | 160 | 180 | 200 | 220 |
| SIXTH HORIZONTAL SCANNING PERIOD: H6 | G6 | 80 | 80 | 120 | 140 | 160 | 180 | 200 | 220 |
| SEVENTH HORIZONTAL SCANNING PERIOD: H7 | G7 | 80 | 80 | 120 | 140 | 160 | 180 | 200 | 220 |
| EIGHTH HORIZONTAL SCANNING PERIOD: H8 | G8 | 80 | 80 | 120 | 140 | 160 | 180 | 200 | 220 |

FIG. 6G

EIGHTH FRAME PERIOD
(EIGHTH VERTICAL SCANNING PERIOD V8)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 60 | 100 | 120 | 140 | 160 | 180 | 200 | 220 |
| SECOND HORIZONTAL SCANNING PERIOD: H2 | G2 | 60 | 100 | 120 | 140 | 160 | 180 | 200 | 220 |
| THIRD HORIZONTAL SCANNING PERIOD: H3 | G3 | 60 | 100 | 120 | 140 | 160 | 180 | 200 | 220 |
| FOURTH HORIZONTAL SCANNING PERIOD: H4 | G4 | 60 | 100 | 120 | 140 | 160 | 180 | 200 | 220 |
| FIFTH HORIZONTAL SCANNING PERIOD: H5 | G5 | 60 | 100 | 120 | 140 | 160 | 180 | 200 | 220 |
| SIXTH HORIZONTAL SCANNING PERIOD: H6 | G6 | 60 | 100 | 120 | 140 | 160 | 180 | 200 | 220 |
| SEVENTH HORIZONTAL SCANNING PERIOD: H7 | G7 | 60 | 100 | 120 | 140 | 160 | 180 | 200 | 220 |
| EIGHTH HORIZONTAL SCANNING PERIOD: H8 | G8 | 60 | 100 | 120 | 140 | 160 | 180 | 200 | 220 |

FIG. 6H

FIRST FRAME PERIOD
(FIRST VERTICAL SCANNING PERIOD V1)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 120 | 160 | 180 | 200 | 200 |
| SECOND HORIZONTAL SCANNING PERIOD: H2 | G2 | 80 | 100 | 120 | 120 | 160 | 180 | 200 | 200 |
| THIRD HORIZONTAL SCANNING PERIOD: H3 | G3 | 80 | 100 | 120 | 120 | 160 | 180 | 200 | 200 |
| FOURTH HORIZONTAL SCANNING PERIOD: H4 | G4 | 80 | 100 | 120 | 120 | 160 | 180 | 200 | 200 |
| FIFTH HORIZONTAL SCANNING PERIOD: H5 | G5 | 80 | 100 | 120 | 120 | 160 | 180 | 200 | 200 |
| SIXTH HORIZONTAL SCANNING PERIOD: H6 | G6 | 80 | 100 | 120 | 120 | 160 | 180 | 200 | 200 |
| SEVENTH HORIZONTAL SCANNING PERIOD: H7 | G7 | 80 | 100 | 120 | 120 | 160 | 180 | 200 | 200 |
| EIGHTH HORIZONTAL SCANNING PERIOD: H8 | G8 | 80 | 100 | 120 | 120 | 160 | 180 | 200 | 200 |

FIG. 8A

SECOND FRAME PERIOD
(SECOND VERTICAL SCANNING PERIOD V2)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 100 | 140 | 160 | 180 | 180 | 220 |
| SECOND HORIZONTAL SCANNING PERIOD: H2 | G2 | 80 | 100 | 100 | 140 | 160 | 180 | 180 | 220 |
| THIRD HORIZONTAL SCANNING PERIOD: H3 | G3 | 80 | 100 | 100 | 140 | 160 | 180 | 180 | 220 |
| FOURTH HORIZONTAL SCANNING PERIOD: H4 | G4 | 80 | 100 | 100 | 140 | 160 | 180 | 180 | 220 |
| FIFTH HORIZONTAL SCANNING PERIOD: H5 | G5 | 80 | 100 | 100 | 140 | 160 | 180 | 180 | 220 |
| SIXTH HORIZONTAL SCANNING PERIOD: H6 | G6 | 80 | 100 | 100 | 140 | 160 | 180 | 180 | 220 |
| SEVENTH HORIZONTAL SCANNING PERIOD: H7 | G7 | 80 | 100 | 100 | 140 | 160 | 180 | 180 | 220 |
| EIGHTH HORIZONTAL SCANNING PERIOD: H8 | G8 | 80 | 100 | 100 | 140 | 160 | 180 | 180 | 220 |

FIG. 8B

THIRD FRAME PERIOD
(THIRD VERTICAL SCANNING PERIOD V3)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 80 | 120 | 140 | 160 | 160 | 200 | 220 |
| SECOND HORIZONTAL SCANNING PERIOD: H2 | G2 | 80 | 80 | 120 | 140 | 160 | 160 | 200 | 220 |
| THIRD HORIZONTAL SCANNING PERIOD: H3 | G3 | 80 | 80 | 120 | 140 | 160 | 160 | 200 | 220 |
| FOURTH HORIZONTAL SCANNING PERIOD: H4 | G4 | 80 | 80 | 120 | 140 | 160 | 160 | 200 | 220 |
| FIFTH HORIZONTAL SCANNING PERIOD: H5 | G5 | 80 | 80 | 120 | 140 | 160 | 160 | 200 | 220 |
| SIXTH HORIZONTAL SCANNING PERIOD: H6 | G6 | 80 | 80 | 120 | 140 | 160 | 160 | 200 | 220 |
| SEVENTH HORIZONTAL SCANNING PERIOD: H7 | G7 | 80 | 80 | 120 | 140 | 160 | 160 | 200 | 220 |
| EIGHTH HORIZONTAL SCANNING PERIOD: H8 | G8 | 80 | 80 | 120 | 140 | 160 | 160 | 200 | 220 |

FIG. 8C

FOURTH FRAME PERIOD
(FOURTH VERTICAL SCANNING PERIOD V4)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 60 | 100 | 120 | 140 | 140 | 180 | 200 | 220 |
| SECOND HORIZONTAL SCANNING PERIOD: H2 | G2 | 60 | 100 | 120 | 140 | 140 | 180 | 200 | 220 |
| THIRD HORIZONTAL SCANNING PERIOD: H3 | G3 | 60 | 100 | 120 | 140 | 140 | 180 | 200 | 220 |
| FOURTH HORIZONTAL SCANNING PERIOD: H4 | G4 | 60 | 100 | 120 | 140 | 140 | 180 | 200 | 220 |
| FIFTH HORIZONTAL SCANNING PERIOD: H5 | G5 | 60 | 100 | 120 | 140 | 140 | 180 | 200 | 220 |
| SIXTH HORIZONTAL SCANNING PERIOD: H6 | G6 | 60 | 100 | 120 | 140 | 140 | 180 | 200 | 220 |
| SEVENTH HORIZONTAL SCANNING PERIOD: H7 | G7 | 60 | 100 | 120 | 140 | 140 | 180 | 200 | 220 |
| EIGHTH HORIZONTAL SCANNING PERIOD: H8 | G8 | 60 | 100 | 120 | 140 | 140 | 180 | 200 | 220 |

FIG. 8D

FIRST FRAME PERIOD
(FIRST VERTICAL SCANNING PERIOD V1)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 120 | 160 | 180 | 200 | 200 |
| SECOND HORIZONTAL SCANNING PERIOD: H2 | G2 | 80 | 100 | 100 | 140 | 160 | 180 | 180 | 220 |
| THIRD HORIZONTAL SCANNING PERIOD: H3 | G3 | 80 | 80 | 120 | 140 | 160 | 160 | 200 | 220 |
| FOURTH HORIZONTAL SCANNING PERIOD: H4 | G4 | 60 | 100 | 120 | 140 | 140 | 180 | 200 | 220 |
| FIFTH HORIZONTAL SCANNING PERIOD: H5 | G5 | 80 | 100 | 120 | 120 | 160 | 180 | 200 | 200 |
| SIXTH HORIZONTAL SCANNING PERIOD: H6 | G6 | 80 | 100 | 100 | 140 | 160 | 180 | 180 | 220 |
| SEVENTH HORIZONTAL SCANNING PERIOD: H7 | G7 | 80 | 80 | 120 | 140 | 160 | 160 | 200 | 220 |
| EIGHTH HORIZONTAL SCANNING PERIOD: H8 | G8 | 60 | 100 | 120 | 140 | 140 | 180 | 200 | 220 |

FIG. 10A

SECOND FRAME PERIOD
(SECOND VERTICAL SCANNING PERIOD V2)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 60 | 100 | 120 | 140 | 140 | 180 | 200 | 220 |
| SECOND HORIZONTAL SCANNING PERIOD: H2 | G2 | 80 | 100 | 120 | 120 | 160 | 180 | 200 | 200 |
| THIRD HORIZONTAL SCANNING PERIOD: H3 | G3 | 80 | 100 | 100 | 140 | 160 | 180 | 180 | 220 |
| FOURTH HORIZONTAL SCANNING PERIOD: H4 | G4 | 80 | 80 | 120 | 140 | 160 | 160 | 200 | 220 |
| FIFTH HORIZONTAL SCANNING PERIOD: H5 | G5 | 60 | 100 | 120 | 140 | 140 | 180 | 200 | 220 |
| SIXTH HORIZONTAL SCANNING PERIOD: H6 | G6 | 80 | 100 | 120 | 120 | 160 | 180 | 200 | 200 |
| SEVENTH HORIZONTAL SCANNING PERIOD: H7 | G7 | 80 | 100 | 100 | 140 | 160 | 180 | 180 | 220 |
| EIGHTH HORIZONTAL SCANNING PERIOD: H8 | G8 | 80 | 80 | 120 | 140 | 160 | 160 | 200 | 220 |

FIG. 10B

THIRD FRAME PERIOD
(THIRD VERTICAL SCANNING PERIOD V3)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 80 | 120 | 140 | 160 | 160 | 200 | 220 |
| SECOND HORIZONTAL SCANNING PERIOD: H2 | G2 | 60 | 100 | 120 | 140 | 140 | 180 | 200 | 220 |
| THIRD HORIZONTAL SCANNING PERIOD: H3 | G3 | 80 | 100 | 120 | 120 | 160 | 180 | 200 | 200 |
| FOURTH HORIZONTAL SCANNING PERIOD: H4 | G4 | 80 | 100 | 100 | 140 | 160 | 180 | 180 | 220 |
| FIFTH HORIZONTAL SCANNING PERIOD: H5 | G5 | 80 | 80 | 120 | 140 | 160 | 160 | 200 | 220 |
| SIXTH HORIZONTAL SCANNING PERIOD: H6 | G6 | 60 | 100 | 120 | 140 | 140 | 180 | 200 | 220 |
| SEVENTH HORIZONTAL SCANNING PERIOD: H7 | G7 | 80 | 100 | 120 | 120 | 160 | 180 | 200 | 200 |
| EIGHTH HORIZONTAL SCANNING PERIOD: H8 | G8 | 80 | 100 | 100 | 140 | 160 | 180 | 180 | 220 |

FIG. 10C

FOURTH FRAME PERIOD
(FOURTH VERTICAL SCANNING PERIOD V4)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 100 | 140 | 140 | 180 | 180 | 220 |
| SECOND HORIZONTAL SCANNING PERIOD: H2 | G2 | 80 | 80 | 120 | 140 | 160 | 160 | 200 | 220 |
| THIRD HORIZONTAL SCANNING PERIOD: H3 | G3 | 60 | 100 | 120 | 140 | 140 | 180 | 200 | 220 |
| FOURTH HORIZONTAL SCANNING PERIOD: H4 | G4 | 80 | 100 | 120 | 120 | 160 | 180 | 200 | 200 |
| FIFTH HORIZONTAL SCANNING PERIOD: H5 | G5 | 80 | 100 | 100 | 140 | 160 | 180 | 180 | 220 |
| SIXTH HORIZONTAL SCANNING PERIOD: H6 | G6 | 80 | 80 | 120 | 140 | 160 | 160 | 200 | 220 |
| SEVENTH HORIZONTAL SCANNING PERIOD: H7 | G7 | 60 | 100 | 120 | 140 | 140 | 180 | 200 | 220 |
| EIGHTH HORIZONTAL SCANNING PERIOD: H8 | G8 | 80 | 100 | 120 | 120 | 160 | 180 | 200 | 200 |

FIG. 10D

FIRST FRAME PERIOD
(FIRST VERTICAL SCANNING PERIOD V1)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 120 | 160 | 180 | 200 | 200 |
| SECOND HORIZONTAL SCANNING PERIOD: H2 | G2 | 80 | 100 | 100 | 140 | 160 | 180 | 180 | 220 |
| THIRD HORIZONTAL SCANNING PERIOD: H3 | G3 | 80 | 80 | 120 | 140 | 160 | 160 | 200 | 220 |
| FOURTH HORIZONTAL SCANNING PERIOD: H4 | G4 | 60 | 100 | 120 | 140 | 140 | 180 | 200 | 220 |
| FIFTH HORIZONTAL SCANNING PERIOD: H5 | G5 | 80 | 100 | 120 | 120 | 160 | 180 | 200 | 200 |
| SIXTH HORIZONTAL SCANNING PERIOD: H6 | G6 | 80 | 100 | 100 | 140 | 160 | 180 | 180 | 220 |
| SEVENTH HORIZONTAL SCANNING PERIOD: H7 | G7 | 80 | 80 | 120 | 140 | 160 | 160 | 200 | 220 |
| EIGHTH HORIZONTAL SCANNING PERIOD: H8 | G8 | 60 | 100 | 120 | 140 | 140 | 180 | 200 | 220 |

FIG. 12A

SECOND FRAME PERIOD
(SECOND VERTICAL SCANNING PERIOD V2)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 60 | 100 | 120 | 140 | 140 | 180 | 200 | 220 |
| SECOND HORIZONTAL SCANNING PERIOD: H2 | G2 | 80 | 100 | 120 | 120 | 160 | 180 | 200 | 200 |
| THIRD HORIZONTAL SCANNING PERIOD: H3 | G3 | 80 | 100 | 100 | 140 | 160 | 180 | 180 | 220 |
| FOURTH HORIZONTAL SCANNING PERIOD: H4 | G4 | 80 | 80 | 120 | 140 | 160 | 160 | 200 | 220 |
| FIFTH HORIZONTAL SCANNING PERIOD: H5 | G5 | 60 | 100 | 120 | 140 | 140 | 180 | 200 | 220 |
| SIXTH HORIZONTAL SCANNING PERIOD: H6 | G6 | 80 | 100 | 120 | 120 | 160 | 180 | 200 | 200 |
| SEVENTH HORIZONTAL SCANNING PERIOD: H7 | G7 | 80 | 100 | 100 | 140 | 160 | 180 | 180 | 220 |
| EIGHTH HORIZONTAL SCANNING PERIOD: H8 | G8 | 80 | 80 | 120 | 140 | 160 | 160 | 200 | 220 |

FIG. 12B

THIRD FRAME PERIOD
(THIRD VERTICAL SCANNING PERIOD V3)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 80 | 120 | 140 | 160 | 160 | 200 | 220 |
| SECOND HORIZONTAL SCANNING PERIOD: H2 | G2 | 60 | 100 | 120 | 140 | 140 | 180 | 200 | 220 |
| THIRD HORIZONTAL SCANNING PERIOD: H3 | G3 | 80 | 100 | 120 | 120 | 160 | 180 | 200 | 200 |
| FOURTH HORIZONTAL SCANNING PERIOD: H4 | G4 | 80 | 100 | 100 | 140 | 160 | 180 | 180 | 220 |
| FIFTH HORIZONTAL SCANNING PERIOD: H5 | G5 | 80 | 80 | 120 | 140 | 160 | 160 | 200 | 220 |
| SIXTH HORIZONTAL SCANNING PERIOD: H6 | G6 | 60 | 100 | 120 | 140 | 140 | 180 | 200 | 220 |
| SEVENTH HORIZONTAL SCANNING PERIOD: H7 | G7 | 80 | 100 | 120 | 120 | 160 | 180 | 200 | 200 |
| EIGHTH HORIZONTAL SCANNING PERIOD: H8 | G8 | 80 | 100 | 100 | 140 | 160 | 180 | 180 | 220 |

FIG. 12C

FOURTH FRAME PERIOD
(FOURTH VERTICAL SCANNING PERIOD V4)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 100 | 140 | 160 | 180 | 180 | 220 |
| SECOND HORIZONTAL SCANNING PERIOD: H2 | G2 | 80 | 80 | 120 | 140 | 160 | 160 | 200 | 220 |
| THIRD HORIZONTAL SCANNING PERIOD: H3 | G3 | 60 | 100 | 120 | 140 | 140 | 180 | 200 | 220 |
| FOURTH HORIZONTAL SCANNING PERIOD: H4 | G4 | 80 | 100 | 120 | 120 | 160 | 180 | 200 | 200 |
| FIFTH HORIZONTAL SCANNING PERIOD: H5 | G5 | 80 | 100 | 100 | 140 | 160 | 180 | 180 | 220 |
| SIXTH HORIZONTAL SCANNING PERIOD: H6 | G6 | 80 | 80 | 120 | 140 | 160 | 160 | 200 | 220 |
| SEVENTH HORIZONTAL SCANNING PERIOD: H7 | G7 | 60 | 100 | 120 | 140 | 140 | 180 | 200 | 220 |
| EIGHTH HORIZONTAL SCANNING PERIOD: H8 | G8 | 80 | 100 | 120 | 120 | 160 | 180 | 200 | 200 |

FIG. 12D

FIFTH FRAME PERIOD
(FIFTH VERTICAL SCANNING PERIOD V5)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 120 | 120 | 160 | 180 | 200 | 200 |
| SECOND HORIZONTAL SCANNING PERIOD: H2 | G2 | 80 | 100 | 100 | 140 | 160 | 180 | 180 | 220 |
| THIRD HORIZONTAL SCANNING PERIOD: H3 | G3 | 80 | 80 | 120 | 140 | 160 | 160 | 200 | 220 |
| FOURTH HORIZONTAL SCANNING PERIOD: H4 | G4 | 60 | 100 | 120 | 140 | 140 | 180 | 200 | 220 |
| FIFTH HORIZONTAL SCANNING PERIOD: H5 | G5 | 80 | 100 | 120 | 120 | 160 | 180 | 200 | 200 |
| SIXTH HORIZONTAL SCANNING PERIOD: H6 | G6 | 80 | 100 | 100 | 140 | 160 | 180 | 180 | 220 |
| SEVENTH HORIZONTAL SCANNING PERIOD: H7 | G7 | 80 | 80 | 120 | 140 | 160 | 160 | 200 | 220 |
| EIGHTH HORIZONTAL SCANNING PERIOD: H8 | G8 | 60 | 100 | 120 | 140 | 140 | 180 | 200 | 220 |

FIG. 12E

SIXTH FRAME PERIOD
(SIXTH VERTICAL SCANNING PERIOD V6)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 60 | 100 | 120 | 140 | 140 | 180 | 200 | 220 |
| SECOND HORIZONTAL SCANNING PERIOD: H2 | G2 | 80 | 100 | 120 | 120 | 160 | 180 | 200 | 200 |
| THIRD HORIZONTAL SCANNING PERIOD: H3 | G3 | 80 | 100 | 100 | 140 | 160 | 180 | 180 | 220 |
| FOURTH HORIZONTAL SCANNING PERIOD: H4 | G4 | 80 | 80 | 120 | 140 | 160 | 160 | 200 | 220 |
| FIFTH HORIZONTAL SCANNING PERIOD: H5 | G5 | 60 | 100 | 120 | 140 | 140 | 180 | 200 | 220 |
| SIXTH HORIZONTAL SCANNING PERIOD: H6 | G6 | 80 | 100 | 120 | 120 | 160 | 180 | 200 | 200 |
| SEVENTH HORIZONTAL SCANNING PERIOD: H7 | G7 | 80 | 100 | 100 | 140 | 160 | 180 | 180 | 220 |
| EIGHTH HORIZONTAL SCANNING PERIOD: H8 | G8 | 80 | 80 | 120 | 140 | 160 | 160 | 200 | 220 |

FIG. 12F

SEVENTH FRAME PERIOD
(SEVENTH VERTICAL SCANNING PERIOD V7)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 80 | 120 | 140 | 160 | 160 | 200 | 220 |
| SECOND HORIZONTAL SCANNING PERIOD: H2 | G2 | 60 | 100 | 120 | 140 | 140 | 180 | 200 | 220 |
| THIRD HORIZONTAL SCANNING PERIOD: H3 | G3 | 80 | 100 | 120 | 120 | 160 | 180 | 200 | 200 |
| FOURTH HORIZONTAL SCANNING PERIOD: H4 | G4 | 80 | 100 | 100 | 140 | 160 | 180 | 180 | 220 |
| FIFTH HORIZONTAL SCANNING PERIOD: H5 | G5 | 80 | 80 | 120 | 140 | 160 | 160 | 200 | 220 |
| SIXTH HORIZONTAL SCANNING PERIOD: H6 | G6 | 60 | 100 | 120 | 140 | 140 | 180 | 200 | 220 |
| SEVENTH HORIZONTAL SCANNING PERIOD: H7 | G7 | 80 | 100 | 120 | 120 | 160 | 180 | 200 | 200 |
| EIGHTH HORIZONTAL SCANNING PERIOD: H8 | G8 | 80 | 100 | 100 | 140 | 160 | 180 | 180 | 220 |

FIG. 12G

EIGHTH FRAME PERIOD
(EIGHTH VERTICAL SCANNING PERIOD V8)

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 80 | 100 | 100 | 140 | 160 | 180 | 180 | 220 |
| SECOND HORIZONTAL SCANNING PERIOD: H2 | G2 | 80 | 80 | 120 | 140 | 160 | 160 | 200 | 220 |
| THIRD HORIZONTAL SCANNING PERIOD: H3 | G3 | 60 | 100 | 120 | 140 | 140 | 180 | 200 | 220 |
| FOURTH HORIZONTAL SCANNING PERIOD: H4 | G4 | 80 | 100 | 120 | 120 | 160 | 180 | 200 | 200 |
| FIFTH HORIZONTAL SCANNING PERIOD: H5 | G5 | 80 | 100 | 100 | 140 | 160 | 180 | 180 | 220 |
| SIXTH HORIZONTAL SCANNING PERIOD: H6 | G6 | 80 | 80 | 120 | 140 | 160 | 160 | 200 | 220 |
| SEVENTH HORIZONTAL SCANNING PERIOD: H7 | G7 | 60 | 100 | 120 | 140 | 140 | 180 | 200 | 220 |
| EIGHTH HORIZONTAL SCANNING PERIOD: H8 | G8 | 80 | 100 | 120 | 120 | 160 | 180 | 200 | 200 |

FIG. 12H (0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 77.5 | 97.5 | 118 | 138 | 158 | 178 | 198 | 218 |
| SECOND HORIZONTAL SCANNING PERIOD: H2 | G2 | 77.5 | 97.5 | 118 | 138 | 158 | 178 | 198 | 218 |
| THIRD HORIZONTAL SCANNING PERIOD: H3 | G3 | 77.5 | 97.5 | 118 | 138 | 158 | 178 | 198 | 218 |
| FOURTH HORIZONTAL SCANNING PERIOD: H4 | G4 | 77.5 | 97.5 | 118 | 138 | 158 | 178 | 198 | 218 |
| FIFTH HORIZONTAL SCANNING PERIOD: H5 | G5 | 77.5 | 97.5 | 118 | 138 | 158 | 178 | 198 | 218 |
| SIXTH HORIZONTAL SCANNING PERIOD: H6 | G6 | 77.5 | 97.5 | 118 | 138 | 158 | 178 | 198 | 218 |
| SEVENTH HORIZONTAL SCANNING PERIOD: H7 | G7 | 77.5 | 97.5 | 118 | 138 | 158 | 178 | 198 | 218 |
| EIGHTH HORIZONTAL SCANNING PERIOD: H8 | G8 | 77.5 | 97.5 | 118 | 138 | 158 | 178 | 198 | 218 |

FIG. 14

(0~255)
8-BIT GRADATION DISPLAY

| HORIZONTAL SCANNING PERIOD H | PIXEL / SCANNING LINE | S1 FIRST PIXEL (COLUMN) 21a | S2 SECOND PIXEL (COLUMN) 21b | S3 THIRD PIXEL (COLUMN) 21c | S4 FOURTH PIXEL (COLUMN) 21d | S5 FIFTH PIXEL (COLUMN) 21e | S6 SIXTH PIXEL (COLUMN) 21f | S7 SEVENTH PIXEL (COLUMN) 21g | S8 EIGHTH PIXEL (COLUMN) 21h |
|---|---|---|---|---|---|---|---|---|---|
| FIRST HORIZONTAL SCANNING PERIOD: H1 | G1 | 75 | 95 | 115 | 135 | 155 | 175 | 195 | 215 |
| SECOND HORIZONTAL SCANNING PERIOD: H2 | G2 | 75 | 95 | 115 | 135 | 155 | 175 | 195 | 215 |
| THIRD HORIZONTAL SCANNING PERIOD: H3 | G3 | 75 | 95 | 115 | 135 | 155 | 175 | 195 | 215 |
| FOURTH HORIZONTAL SCANNING PERIOD: H4 | G4 | 75 | 95 | 115 | 135 | 155 | 175 | 195 | 215 |
| FIFTH HORIZONTAL SCANNING PERIOD: H5 | G5 | 75 | 95 | 115 | 135 | 155 | 175 | 195 | 215 |
| SIXTH HORIZONTAL SCANNING PERIOD: H6 | G6 | 75 | 95 | 115 | 135 | 155 | 175 | 195 | 215 |
| SEVENTH HORIZONTAL SCANNING PERIOD: H7 | G7 | 75 | 95 | 115 | 135 | 155 | 175 | 195 | 215 |
| EIGHTH HORIZONTAL SCANNING PERIOD: H8 | G8 | 75 | 95 | 115 | 135 | 155 | 175 | 195 | 215 |

FIG. 15

ELECTRO-OPTICAL DEVICE, DRIVING METHOD FOR ELECTRO-OPTICAL DEVICE, AND ELECTRONIC APPARATUS

The present application is based on, and claims priority from JP Application Serial Number 2018-161122, filed Aug. 30, 2018, the disclosure of which is hereby incorporated by reference herein in its entirety.

BACKGROUND

1. Technical Field

The disclosure relates to an electro-optical device, a driving method for the electro-optical device, and an electronic apparatus.

2. Related Art

A liquid crystal device is known as one of electro-optical devices, for example. The liquid crystal device forms an image by utilizing dielectric anisotropy of a liquid crystal and optical rotation of light in a liquid crystal layer. In the liquid crystal device, scanning lines and signal lines are arranged in an image display region, and pixels are arranged in a matrix at intersection points of the scanning lines and the signal lines. A pixel transistor is disposed in the pixel, and an image is formed by supplying an image signal to each pixel via the pixel transistor.

As a method for obtaining an image with high display quality in a liquid crystal device, for example, as described in JP-A-2012-150496, a driving method is known in which a data line supplying an image signal is divided into a plurality of blocks, and a plurality of the data lines in each block are sequentially selected in one horizontal period to supply the image signal, accordingly a writing time to the pixels is secured and display quality is improved (demultiplexer driving method).

However, further high resolution and high speed driving are desired in the future, and there is a problem that it becomes difficult to secure the writing time to the pixels as the resolution is increased and the driving speed is increased.

SUMMARY

An electro-optical device according to the present disclosure includes a plurality of signal lines, a plurality of scanning lines, pixels arranged corresponding to intersections of the plurality of signal lines and the plurality of scanning lines, image signal lines arranged respectively corresponding to k signal lines among the plurality of signal lines, k switches arranged between the image signal lines and the k signal lines respectively, a selection signal output circuit configured to output a selection signal for selecting the k switches, and an image signal output circuit configured to output an image signal to the pixels via the image signal lines, wherein the selection signal output circuit outputs a selection signal for simultaneously selecting a set of switches, which correspond to a set of adjacent signal lines, among the k switches in a partial period obtained by time-dividing a horizontal scanning period, and outputs a selection signal for selecting remaining switches among the k switches one at a time in a remaining period of the time-divided horizontal scanning period, and the image signal output circuit supplies a same image signal to a set of adjacent signal lines corresponding to the simultaneously selected set of switches in a partial period obtained by time-dividing the horizontal scanning period.

In the electro-optical device described above, the selection signal output circuit may change, at predetermined time intervals, a combination of the set of switches that are simultaneously selected.

In the electro-optical device described above, the selection signal output circuit may perform p-time speed driving that supplies a same image signal to the pixels p tunes for each vertical scanning period, and may change, p times or 2/p times in p vertical scanning periods, a combination of the set of switches that are simultaneously selected.

In the electro-optical device described above, the selection signal output circuit may simultaneously select two sets of switches, which respectively correspond to two sets of adjacent signal lines, among the k switches in a partial time period obtained by time-dividing the horizontal scanning period, and may supply a first image signal to a first set of adjacent signal lines corresponding to a first set of switches and also supply a second image signal to a second set of adjacent signal lines corresponding to a second set of switches.

In the electro-optical device described above, a vertical scanning period may include a first horizontal scanning period and a second horizontal scanning period, and the selection signal output circuit may change a combination of the set of switches that are simultaneously selected in the first horizontal scanning period and the second horizontal scanning period.

In the electro-optical device described above, the selection signal output circuit may supply an image signal, which is to be supplied to any one signal line of the set of adjacent signal lines corresponding to the set of switches that are simultaneously selected, to also the other signal line of the set of adjacent signal lines corresponding to the set of switches that are simultaneously selected.

In the electro-optical device described above, the image signal output circuit may supply an image signal, which is obtained by averaging image signals in a plurality of vertical scanning periods, to a set of adjacent signal lines corresponding to the set of switches that are simultaneously selected.

There is a driving method for the electro-optical device according to the present disclosure, and the electro-optical device includes a plurality of signal lines, a plurality of scanning lines, pixels arranged corresponding to intersections of the plurality of signal lines and the plurality of scanning lines, image signal lines arranged respectively corresponding to k signal lines among the plurality of signal lines, k switches arranged between the image signal lines and the k signal lines respectively, a selection signal output circuit configured to output a selection signal for selecting k switches, and an image signal output circuit configured to output an image signal to the pixels via the image signal lines, the driving method including outputting by the selection signal output circuit a selection signal for simultaneously selecting a set of switches, which correspond to a set of adjacent signal lines, among the k switches in a partial period obtained by time-dividing a horizontal scanning period, and outputting a selection signal for selecting remaining switches among the k switches one at a time in a remaining period of the time-divided horizontal scanning period; and supplying by the image signal output circuit a same image signal to a set of adjacent signal lines corresponding to the set of switches that are simultaneously selected in a partial period obtained by time-dividing the horizontal scanning period.

In the driving method for the electro-optical device described above, the selection signal output circuit may change, at predetermined time intervals, a combination of the set of switches that are simultaneously selected.

In the driving method for the electro-optical device described above, the selection signal output circuit may perform p-time speed driving that supplies a same image signal to the pixels p times for each vertical scanning period, and may change, p times or 2/p times in p vertical scanning periods, a combination of the set of switches that are simultaneously selected.

In the driving method for the electro-optical device described above, the selection signal output circuit may simultaneously select two sets of switches, which respectively correspond to two sets of adjacent signal lines, among the k switches in a partial time period obtained by time-dividing the horizontal scanning period, and may supply a first image signal to a first set of adjacent signal lines corresponding to a first set of switches and also supplies a second image signal to a second set of adjacent signal lines corresponding to a second set of switches.

In the driving method for the electro-optical device described above, a vertical scanning period may include a first horizontal scanning period and a second horizontal scanning period, and the selection signal output circuit changes a combination of the set of switches that are simultaneously selected in the first horizontal scanning period and the second horizontal scanning period.

In the driving method for the electro-optical device described above, the selection signal output circuit may supply an image signal, which is to be supplied to any one signal line of a set of adjacent signal lines corresponding to the set of switches that are simultaneously selected, to also the other signal line of a set of adjacent signal lines corresponding to the set of switches that are simultaneously selected.

In the driving method for the electro-optical device described above, the image signal output circuit may supply an image signal, which is obtained by averaging image signals in a plurality of vertical scanning periods, to a set of adjacent signal lines corresponding to the set of switches that are simultaneously selected.

An electronic apparatus according to the present disclosure includes the electro-optical device described above.

BRIEF DESCRIPTION OF THE DRAWINGS

FIG. 6A is a table showing gradations for each frame period.

FIG. 6B is a table showing the gradations for each frame period.

FIG. 6C is a table showing the gradations for each frame period.

FIG. 6D is a table showing the gradations for each frame period.

FIG. 6E is a table showing the gradations for each frame period.

FIG. 6F is a table showing the gradations for each frame period.

FIG. 6G is a table showing the gradations for each frame period.

FIG. 6H is a table showing the gradations for each frame period.

FIG. 8A is a table showing gradations for each frame period.

FIG. 8B is a table showing the gradations for each frame period.

FIG. 8C is a table showing the gradations for each frame period.

FIG. 8D is a table showing the gradations for each frame period.

FIG. 10A is a table showing gradations for each frame period.

FIG. 10B is a table showing the gradations for each frame period.

FIG. 10C is a table showing the gradations for each frame period.

FIG. 10D is a table showing the gradations for each frame period.

FIG. 12A is a table showing gradations for each frame period.

FIG. 12B is a table showing the gradations for each frame period.

FIG. 12C is a table showing the gradations for each frame period.

FIG. 12D is a table showing the gradations for each frame period.

FIG. 12E is a table showing the gradations for each frame period.

FIG. 12F is a table showing the gradations for each frame period.

FIG. 12G is a table showing the gradations for each frame period.

FIG. 12H is a table showing the gradations for each frame period.

FIG. 14 is a table showing gradations of the modified example.

FIG. 15 is a table showing the gradations of the modified example.

DESCRIPTION OF EXEMPLARY EMBODIMENTS

Embodiments will be described below with reference to the accompanying drawings.

First Exemplary Embodiment

Outline of Electronic Apparatus

Figure 1:
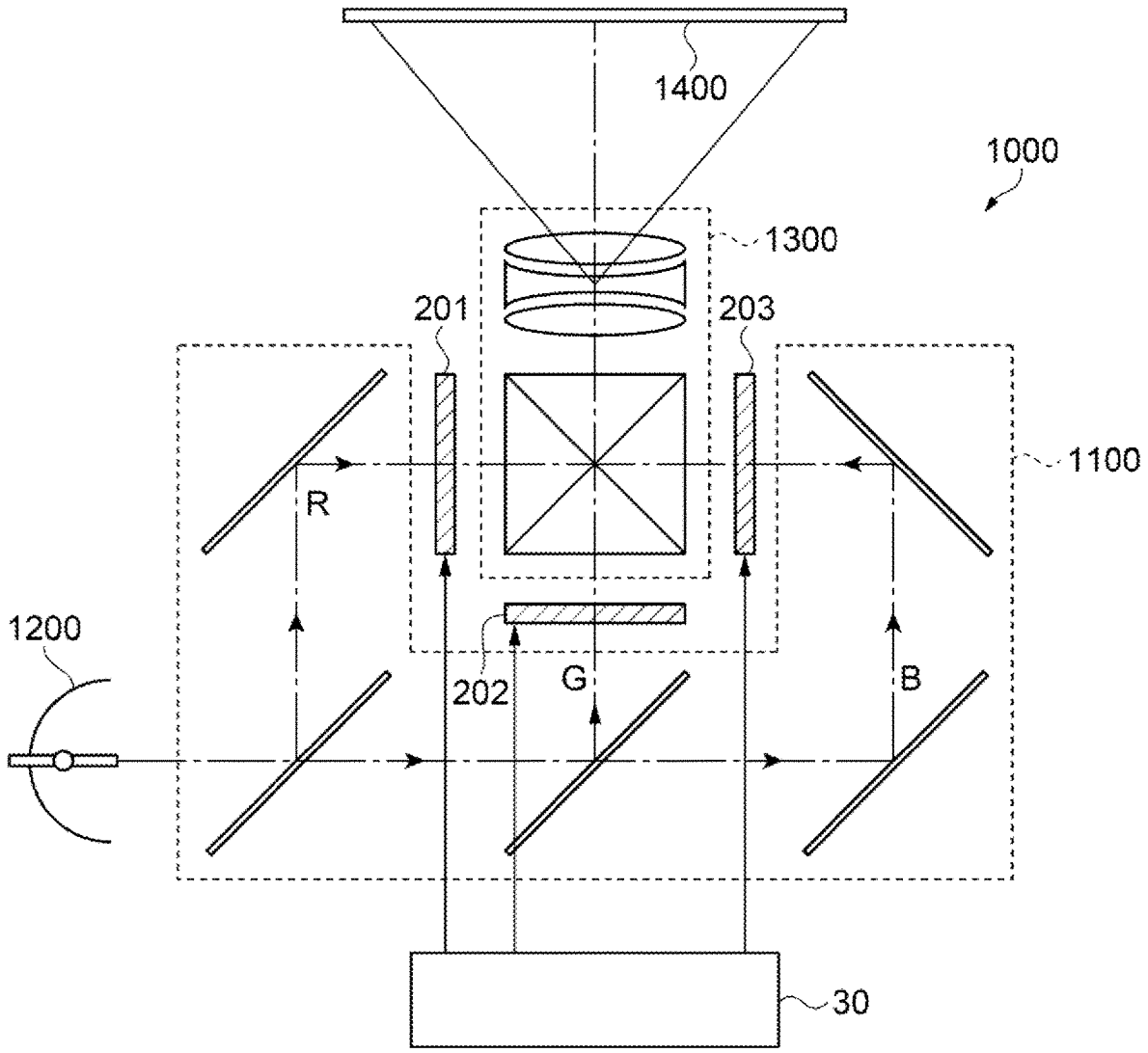
FIG. 1 is a schematic diagram illustrating a configuration of a projector, which is an example of an electronic apparatus of First Exemplary Embodiment.

FIG. 1 is a schematic diagram illustrating a configuration of a projector, which is an example of an electronic apparatus according to the present embodiment. Hereinafter, a configuration of a projector will be described with reference to FIG. 1.

As illustrated in FIG. 1, the projector 1000 at least includes three electro-optical devices 20 (see FIG. 2, hereinafter, also referred to as a first liquid crystal panel 201, a second liquid crystal panel 202, and a third liquid crystal panel 203), and a control device 30 that supplies control signals to the electro-optical devices 20.

The first liquid crystal panel 201, the second liquid crystal panel 202, and the third liquid crystal panel 203 are three electro-optical devices 20 corresponding to different display colors (red, green, and blue).

An illumination optical system 1100 supplies red component R to the first liquid crystal panel 201, green component G to the second liquid crystal panel 202, and blue component B to the third liquid crystal panel 203 among light emitted from an illumination device (light source) 1200. The first liquid crystal panel 201, the second liquid crystal panel 202 and the third liquid crystal panel 203 function as light modulators (light valves) that modulate respective color lights supplied from the illumination optical system 1100 depending on a display image. A projection optical system 1300 combines the light emitted from the first liquid crystal panel 201, the second liquid crystal panel 202, and the third liquid crystal panel 203 and projects the combined light onto a projection surface 1400.

Circuit Configuration of Electro-Optical Device

Figure 2:
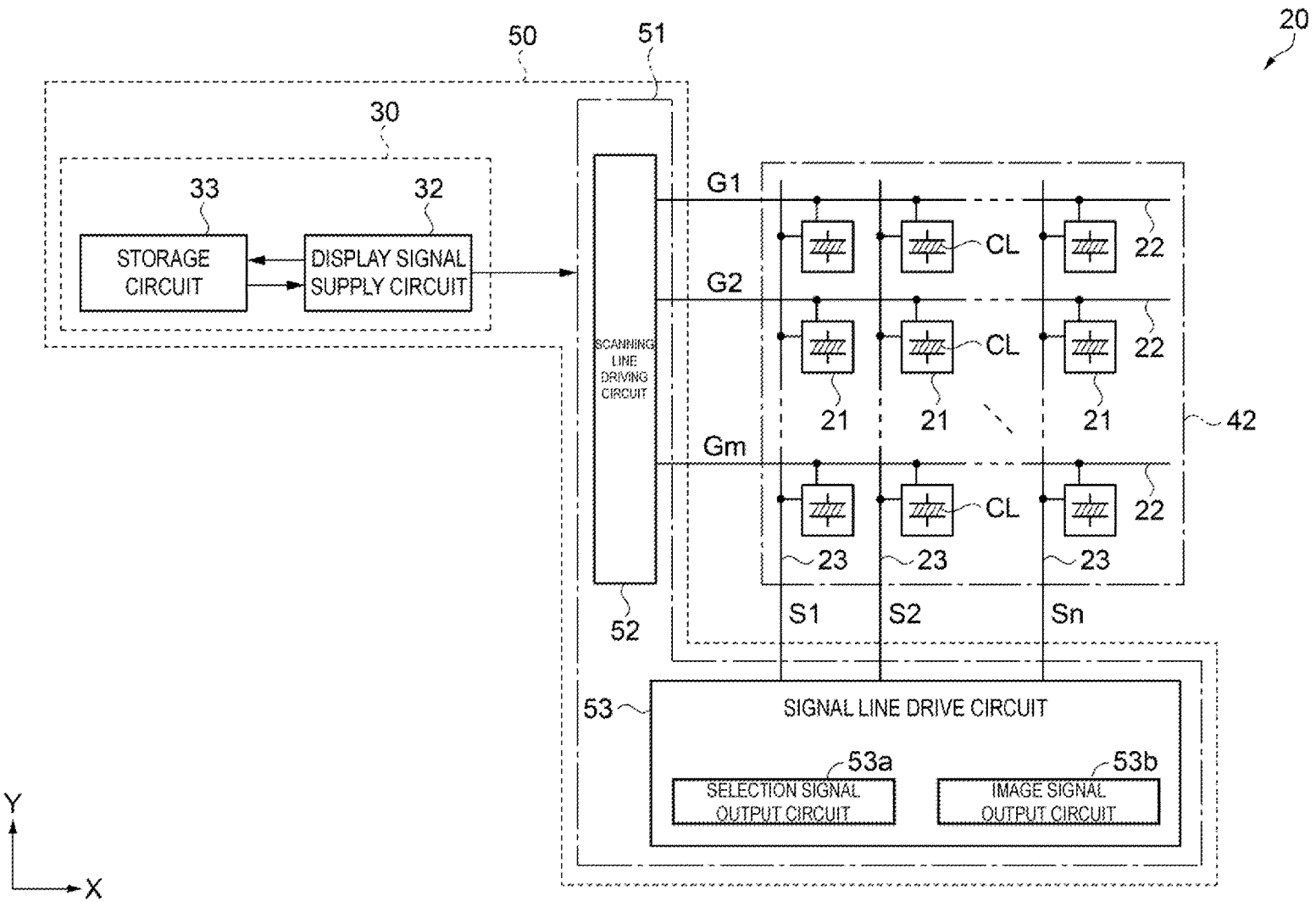
FIG. 2 is a circuit block diagram illustrating a configuration of an electro-optical device.

FIG. 2 is a block diagram illustrating a configuration of an electro-optical device. The configuration of the electro-optical device will be described below with reference to the block diagram illustrated in FIG. 2.

As illustrated in FIG. 2, the electro-optical device 20 at least includes a display region 42 and a driving unit 50. In the display region 42, a plurality of scanning lines 22 and a plurality of signal lines 23 which cross each other are formed, and pixels 21 are arranged in a matrix corresponding to each intersection of the scanning lines 22 and the signal lines 23.

In the display region 42, m scanning lines 22 (m is an integer not less than two) and n signal lines 23 (n is an integer not less than two) are formed. The scanning lines 22 extend in a row direction (X direction). The signal lines 23 extend in a column direction (Y direction). Note that, in the present embodiment, the electro-optical device 20 and the driving method of the electro-optical device 20 will be described with m=2168 and n=4112 as an example. In this case, a so-called 4K image of 2160 rows×4096 columns is displayed in the display region 42 of 2168 rows×4112 columns.

The driving unit 50 is configured to include a driving circuit 51 that drives each of the pixels 21, a display signal supply circuit 32 that supplies a display signal to the driving circuit 51, and a storage circuit 33 that temporarily stores the frame image. The driving circuit 51 is configured to include a scanning line driving circuit 52 and a signal line driving circuit 53. Further, the driving unit 50 supplies a driving signal to the plurality of scanning lines 22 and the plurality of signal lines 23. By supplying various signals from the driving unit 50, an image is displayed in the display region 42.

The display signal supply circuit 32 generates a display signal (such as an image signal and a clock signal) from a frame image stored in the storage circuit 33. Furthermore the display signal supply circuit 32 supplies the generated display signal to the driving circuit 51.

The display region 42 includes a first side (in the present embodiment, a left side of the display region 42), and a second side (in the present embodiment, a right side of the display region 42) opposed (substantially parallel) to the first side across the display region 42. Further, the display region 42 includes a third side (in be present embodiment, a lower side of the display region 42) intersecting (substantially orthogonal) to the first side, and a fourth side opposed (substantially parallel) to the third side across the display region 42.

Figure 4:
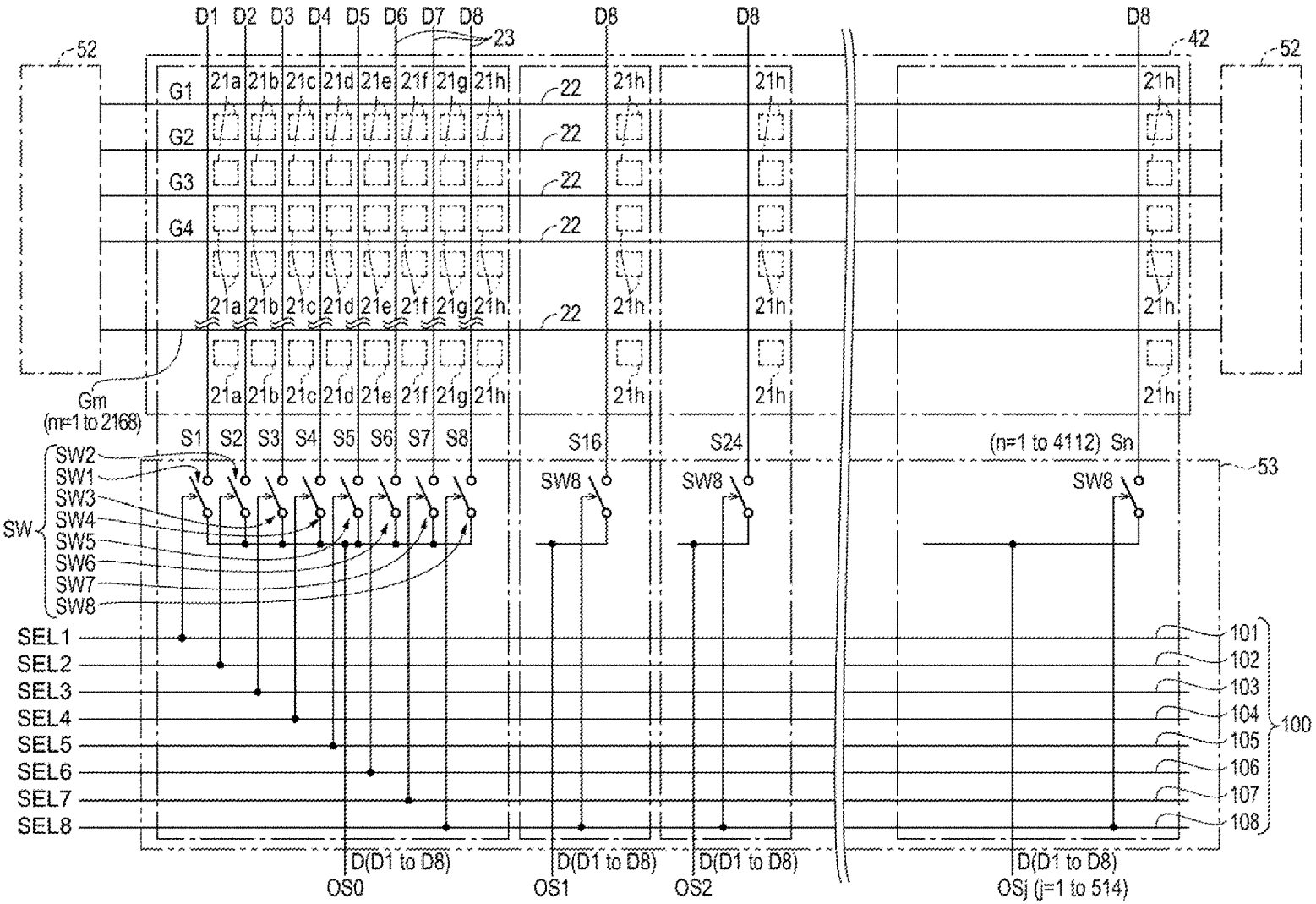
FIG. 4 is a circuit diagram illustrating a configuration of a signal line driving circuit.

The scanning line driving circuit 52 is formed along the first side, the second side, or the first side and the second side of the display region 42. Although omitted in FIG. 2 for clarity, in the present embodiment, as illustrated in FIG. 4, the scanning line driving circuit 52 is formed along the first side and the second side of the display region 42.

The signal line driving circuit 53 is formed along the third side, the fourth side, or the third side and the fourth side of the display region 42. In the present embodiment, the signal line driving circuit 53 is formed along the third side. Further, the signal line driving circuit 53 includes a selection signal output circuit 53*a* that outputs a selection signal to a switch SW to be described later, and an image signal output circuit 53*b* that outputs an image signal to the pixel 21.

The scanning line driving circuit 52 outputs a scanning signal for selecting or non-selecting the pixel 21 in the row direction to each scanning line 22. The scanning line 22 transmits the scanning signal to the pixel. Specifically, the scanning signal has a selected state and a non-selected state. The scanning line 22 can be appropriately selected by receiving the scanning signal from the scanning line driving circuit 52.

The scanning line driving circuit 52 includes a shift register circuit (not illustrated). Specifically, a signal for shifting the shift register circuit is outputted as a shift output signal for each stage. The output signal is used to form a scanning signal. The signal line driving circuit 53 supplies an image signal to each of the n signal lines 23 in synchronization with the selection of the scanning lines 22.

One display image is formed in one frame period. In one frame period, each scanning line 22 is selected at least once. Normally, each scanning line 22 is selected once. Since a period in which one scanning line is selected is referred to as a horizontal scanning period, at least m horizontal scanning periods are included in one frame period. The scanning line 22 is sequentially selected from the scanning line G1 of the first row to the scanning line Gm of the m-th row (or, from the scanning line Gm of the m-th row to the scanning line G1 of the first row) to configure one frame period, thus the frame period is also referred to as a vertical scanning period.

The electro-optical device 20 of the present embodiment is formed with a glass substrate (not illustrated). The driving circuit 51 is formed on a glass substrate with thin film elements such as thin film transistors. The control device 30 includes a display signal supply circuit 32 and a storage circuit 33, and is configured of a semiconductor integrated circuit formed on a single crystal semiconductor substrate.

Beesides this configuration, the configuration also may be that the display region 42 is formed on a glass substrate, the driving circuit 51 is an integrated circuit formed on a single crystal semiconductor substrate, or both the display region 42 and the driving circuit 51 are formed on a single crystal semiconductor substrate.

Configuration of Pixel

Figure 3:
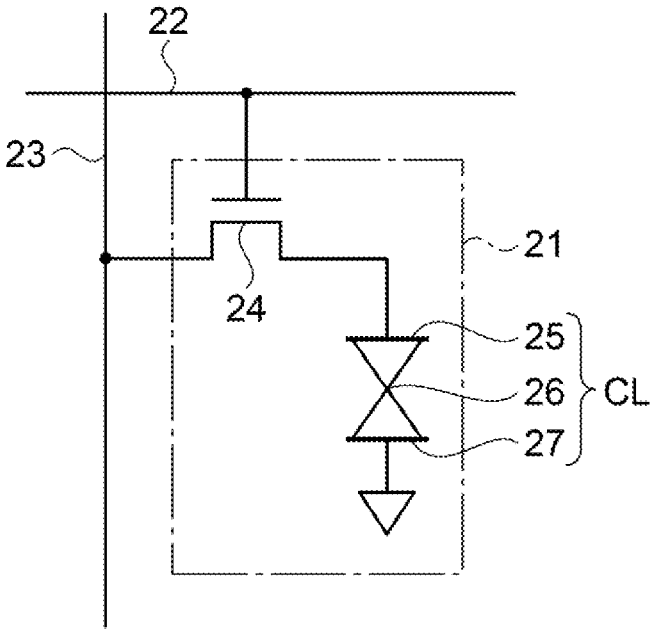
FIG. 3 is a circuit diagram illustrating a configuration of a pixel configuring the electro-optical device.

FIG. 3 is a circuit diagram illustrating a configuration of a pixel configuring the electro-optical device. The configuration of the pixel will be described below with reference to FIG. 3.

The electro-optical device 20 of the present embodiment is, for example, a liquid crystal device. The electro-optical material is liquid crystal 26. As illustrated in FIG. 3, each pixel 21 is configured to include a liquid crystal element LC and a pixel transistor 24.

The liquid crystal element LC includes a pixel electrode 25 and a same electrode 27 facing each other. The liquid crystal element LC is an electro-optical element in which a liquid crystal 26 as an electro-optical material is arranged between the pixel electrode 25 and the same electrode 27. Depending on the electric field applied between the pixel electrode 25 and the same electrode 27, the transmittance of light passing through the liquid crystal 26 changes.

Note that, an electrophoretic material may be used as the electro-optical material rather than a liquid crystal 26. In this case, the electro-optical device 20 serves as an electrophoresis device and is used in an electronic book or the like.

The pixel transistor 24 is configured of an N-type thin film transistor in which the gate is connected to the scanning line 22. Further, the pixel transistor 24 is interposed between the pixel electrode 25 and the signal line 23 to control the electrical connections (conduction/non-conduction) of the two.

Accordingly, by the signal line driving circuit 53, the pixel 21 (liquid crystal element LC) performs display according to the potential (image signal) supplied to the signal line 23 when the pixel transistor 24 is turned on. Note that the illustration of an auxiliary capacitance and the like connected in parallel to the liquid crystal element LC is omitted.

Circuit Configuration of Signal Line Driving Circuit

FIG. 4 is a circuit diagram illustrating a configuration of a signal line driving circuit. Hereinafter, a configuration of the signal line driving circuit will be described with reference to FIG. 4.

As illustrated in FIG. 4, the signal line driving circuit 53 is formed along the third side of the display region 42. The signal line driving circuit 53 includes, for example, selection signal lines 100 from the first selection signal line 101 to the eighth selection signal line 108 to which selection signal SEL (first selection signal SEL1 to eighth selection signal SEL8) is supplied, and switches SW from the first switch SW1 to the eighth switch SW8.

The signal line driving circuit 53 divides the signal line 23 that supplies the image signal D into k blocks (k is an integer not less than two), and by sequentially selecting n signal lines 23 (signal line group) in each block in one horizontal scanning period and supplying the image signal D, a writing time to the pixels 21 (pixels 21*a* to 21*h*) can be secured. Such a driving method is referred to as a demultiplexer driving method.

The number n of signal lines 23 is n=4112, for example. In the present embodiment, the first selection signal line 101 to the eighth selection signal line 108 is used, and thus the number j of image signal lines OSj is j=514 (4112/8SEL). In other words, the number n of signal lines 23 selected by the first selection signal SEL1 is n=514. Similarly, the number n of signal lines selected by the second selection signal SEL2 to the eighth selection signal. SEL8 is n=514 respectively.

The first image signal line OS1 is electrically coupled to the signal line 23 from the first signal line S1 to the eighth signal line S8. Thereafter, similar circuit configurations are repeatedly formed from the second image signal line OS2 to the j-th image signal line OSj.

Further, the signal line driving circuit 53 is provided with the first switch SW1 to the eighth switch SW8. Similar to the pixel transistors 24, the first switch SW1 to the eighth switch SW8 are formed of thin film ansistors.

The first switch SW1 is arranged between the first signal line S1 and the first image signal line OS1. One end (one of the source and the drain) of the first switch SW1 is electrically coupled to the first signal line S1. The other end (the other of the source and the drain) of the first switch SW1 is electrically coupled to the first image signal line OS1. The gate of the first switch SW1 is electrically coupled to the first selection signal line 101.

For example, when the first selection signal SEL1 becomes a selection signal, the first switch SW1 is turned on, and the first image signal D1 is supplied to the first signal S1. When the second selection signal SEL2 becomes a selection signal, the second switch SW2 is turned on, and the second image signal D2 is supplied to the second signal line S2. The image signal D is supplied to eight signal lines 23 by repeating similarly.

Note that in the present specification, for example, the wiring 1 and the wiring 2 are electrically coupled means that the wiring 1 and the wiring 2 can be in the same logic state (potential on the design concept). Specifically, in addition to the case where the wiring 1 and the wiring 2 are directly coupled, the ease where the wiring 1 and the wiring 2 are connected via low resistance, switching elements or the like are included.

That is, even when the potential at the wiring 1 and the potential at the wiring 2 are slightly different, when the same logic is given on the circuit, the wiring 1 and the wiring 2 are electrically coupled. Therefore, for example, as illustrated in FIG. 4, even when the first switch SW1 is arranged between the first signal line S1 and the first image signal line OS1, the first image signal D1 is supplied to the first signal line S1 when the first switch SW1 is turned on, thus the first signal line S1 and the first image signal line OS1 are electrically coupled.

Driving Method for Electro-Optical Device

FIGS. 5A to 5H are timing charts for illustrating a driving method for the electro-optical device according to First Exemplary Embodiment. FIGS. 6A to 6H are tables showing gradations for each frame period. Hereinafter, the driving method for the electro-optical device will be described below with reference to FIGS. 5A to 5H and FIGS. 6A to 6H.

Figure 5A:
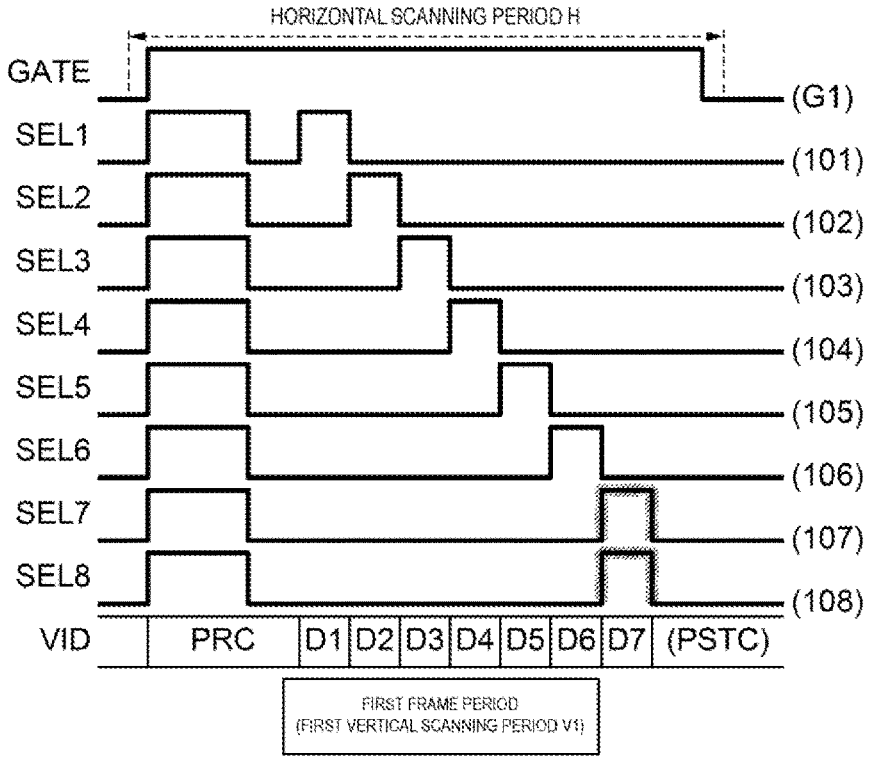
FIG. 5A is a timing chart illustrating a driving method for the electro-optical device.

The timing chart illustrated in FIG. 5A illustrates a scanning signal (gate signal: GATE) supplied to the scanning line 22, each of the selection signals SEL (the first selection signal SEL1 to the eighth selection signal SEL8), and image signal strain (VID) in the horizontal scanning period H in which the first scanning line G1 is selected. The image signal strain (VID) includes a pre-charge signal PRC, an image signal D (the first image signal D1 to the eighth image signal D8), and a post charge signal PSTC. Note that, a circuit for supplying the pre-charge signal PRC and the post charge signal PSTC can use a known circuit, thus the illustration is omitted in FIG. 4.

Note that the pre-charge signal PRC is a signal performed in advance of writing to each of the pixels 21. By performing the pre-charge operation, vertical crosstalk caused by the light leakage current of the pixel transistor 24 is suppressed. Further, the post charge signal PSTC is a signal that interpolates the pre-charge signal PRC. Description of the pre-charge signal PRC and the post charge signal PSTC will be omitted below.

Here, one vertical scanning period V (one frame period: one screen) includes m horizontal scanning periods Hm. For example, m is an integer of 1 to 2168. The timing chart illustrated in FIG. 5A illustrates the timing of each signal in one horizontal scanning period H. Note that in First Exemplary Embodiment, the same timing chart is used in the m horizontal scanning periods Hm.

As the driving method of First Exemplary Embodiment, a combination of the signal lines 23 that are simultaneously selected is changed for each frame period. For example, when the drive frequency is 60 Hz, one frame (one screen) is rewritten 60 times per second. That is, for each screen (each frame), the combination of the signal lines 23 that are simultaneously selected is changed.

Note that, the drive frequency S (S is a multiple of 60) of the present embodiment is 240 Hz (referred to as a four-time speed driving). In the case of the four-time speed driving, in the first frame period of FIG. 5A to the fourth frame of FIG. 5D, display based on the first image signal for displaying the first image is repeatedly performed. Further, in the fifth frame of FIG. 5E to the eighth frame of FIG. 5H, display based on the second image signal for displaying the second image is repeatedly displayed.

Note that the drive frequency S is not limited to 240 Hz, and may be 120 Hz (two-time speed driving), 180 Hz (three-time speed driving), 480 Hz (eight-time speed driving), and the like. Additionally, the drive frequency S is not limited to one-time speed driving, and may be 60 Hz.

As illustrated in FIG. 5A, in the driving method according to First Exemplary Embodiment, the signal line driving circuit 53 supplies the pre-charge signal PRC to all of the signal lines 23, and then supplies each of the image signals D. In the method for supplying each of the image signals D, first, during the horizontal scanning period H1, the first selection signal SEL1 is supplied to the first selection signal line 101 to turn on the first switch SW1, and the first signal line S1 is selected (see FIG. 4). Then, the first image signal D1 is supplied to the selected first signal line S1 via the first image signal line OS1. Accordingly, the first image signal D1 is written to the first pixel 21*a* in the first row (corresponding to the first scanning line G1).

Next, the signal line driving circuit 53 supplies the second selection signal SEL2 to the second selection signal line 102 to turn on the second switch SW2 and to select the second signal line S2. Then, the second image signal D2 is supplied to the selected second signal line S2 via the first image signal line OS1. Accordingly, the second image signal D2 is written to the second pixel 21*b* in the first row.

Next, the signal line driving circuit 53 supplies the third selection signal SEL3 to the third selection signal line 103 to turn on the third switch SW3 and to select the third signal line S3. Then, the third image signal D3 is supplied to the selected third signal line S3 via the first image signal line OS1. Accordingly, the third image signal D3 is written to the third pixel 21*c* in the first row.

Next, the signal line driving circuit 53 supplies the fourth selection signal SEL4 to the fourth selection signal line 104 to turn on the fourth switch SW4 and to select the fourth signal line S4. Then, the fourth image signal D4 is supplied to the selected fourth signal line S4 via the first image signal line OS1. Accordingly, the fourth image signal D4 is written to the fourth pixel 21*d* in the first row.

Next, the signal line driving circuit 53 supplies the fifth selection signal SEL5 to the fifth selection signal line 105 to turn on the fifth switch SW5 and to select the fifth signal line S5. Then, the fifth image signal D5 is supplied to the selected fifth signal line S5 via the first image signal line OS1. Accordingly, the fifth image signal D5 is written to the fifth pixel 21*e* in the first row.

Next, the signal line driving circuit 53 supplies the sixth selection signal SEL6 to the sixth selection signal line 106 to turn on the sixth switch SW6 and to select the sixth signal line S6. Then, the sixth image signal D6 is supplied to the selected sixth signal line S6 via the first image signal line OS1. Accordingly, the sixth image signal D6 is written to the sixth pixel 21*f* in the first row.

Next, the signal line driving circuit 53 supplies the seventh selection signal SEL7 to the seventh selection signal line 107, and supplies the eighth selection signal SEL8 to the eighth selection signal line 108, to simultaneously turn on the seventh switch SW7 and the eighth switch SW and to simultaneously select the seventh signal line S7 and the eighth signal line S8. Then, the seventh image signal D7, which is the same image signal D, for example, is supplied to the seventh signal line S7 and the eighth signal line S8 that are selected. Accordingly, the seventh image signal D7, which is the same as image signal D, is written to the seventh pixel 21*g* and the eighth pixel 21*h* in the first row.

Note that, the same image signal D supplied to the seventh signal line S7 and the eighth signal line S8 is not limited to one of the seventh image signal D7, and may supply the other one of the eighth image signal D8. Further, the image signal D obtained by averaging the image signal D to be supplied to the two signal lines be supplied.

Then, the second scanning line G2 is selected, in the horizontal scanning period H of the selected second scanning line G2 (second horizontal scanning period H2), the image signal D is written to the pixels 21 in the second row (corresponding to the second scanning line G2) using the same driving method as described above.

Thereafter, the same driving is performed to the scanning line Gm in the m-th row, and the writing operation for the first frame period (first vertical scanning period V1) is completed.

In this manner, by simultaneously selecting two adjacent signal lines 23 (the seventh signal line S7 and the eighth signal line S8) and supplying seventh image signal D7 to the both, as compared to the case where one signal line 23 is selected to supply the image signal D, the selected period can be shortened by one period. That is, the writing period to the pixels 21 can be shortened, thus the writing period to the pixels 21 can be easily secured within the limited horizontal scanning period H. Further, the horizontal scanning period H can be shortened, thus, it is possible to easily accommodate high resolution and high speed driving by increasing the drive frequency.

FIG. 6A shows a gradation distribution (gradation image) of the display region 42 of a part of the first frame period when driven by the driving method described above. Specifically, it is displayed in 8-bit (0 to 255) gradation.

For example, as described above, in the first scanning line G1 of the first row, the first signal line S1 is selected by the first selection signal SEL1, the first image signal D1 is supplied to the first signal line S1, and a gradation of the first pixel 21*a* when the first image signal D1 is written to the first pixel 21*a* is 80 gradations (portion a).

Further, for example, the second signal line S2 is selected by the second selection signal SEL2, the second image signal D2 is supplied to the second signal line S2, and a gradation of the second pixel 21*b* when the second image signal D2 is written to the second pixel 21*b* is 100 gradations (portion b).

In other words, the first pixel 21*a* corresponds to the first selection signal SEL1, and the second pixel 21*b* corresponds to the second selection signal SEL2. On the other hand, the first scanning line G1 corresponds to the first horizontal scanning period H1, and the second scanning line G2 corresponds to the second horizontal scanning period H2.

That is, the table in FIG. 6A shows gradations of eight horizontal scanning periods H (H1 to H8) when the first signal line S1 to the eighth signal line S8 that are selected by the first selection signal SEL1 to the eighth selection signal SEL8 are supplied with the first image signal D1 to the eighth image signal D8 via the first image signal line OS1.

During the first frame period displayed by the driving method according to First Exemplary Embodiment, the adjacent seventh signal line S7 and eighth signal line S8 are simultaneously selected, and a same image signal D (seventh image signal D7) is written to the seventh pixel 21*g* and the eighth pixel 21*h*, thus the gradations of the pixel column of the seventh pixel 21*g* and the pixel column of the eighth pixel 21*h* are both 200 gradations. Hereinafter, the same gradation display in the column direction (H1 to H8) of the display region 42 is shown by being driven in the same manner.

Further, in this way, the same image signal D is supplied to the adjacent pixels 21, thus, deterioration of the display image can be suppressed without greatly differing the gradation. Hereinafter, in description of the driving method in the second frame period to the eighth frame period (each vertical scanning period V), and description of the gradations in each frame period, only the characteristic parts will be mainly described.

Figure 5B:
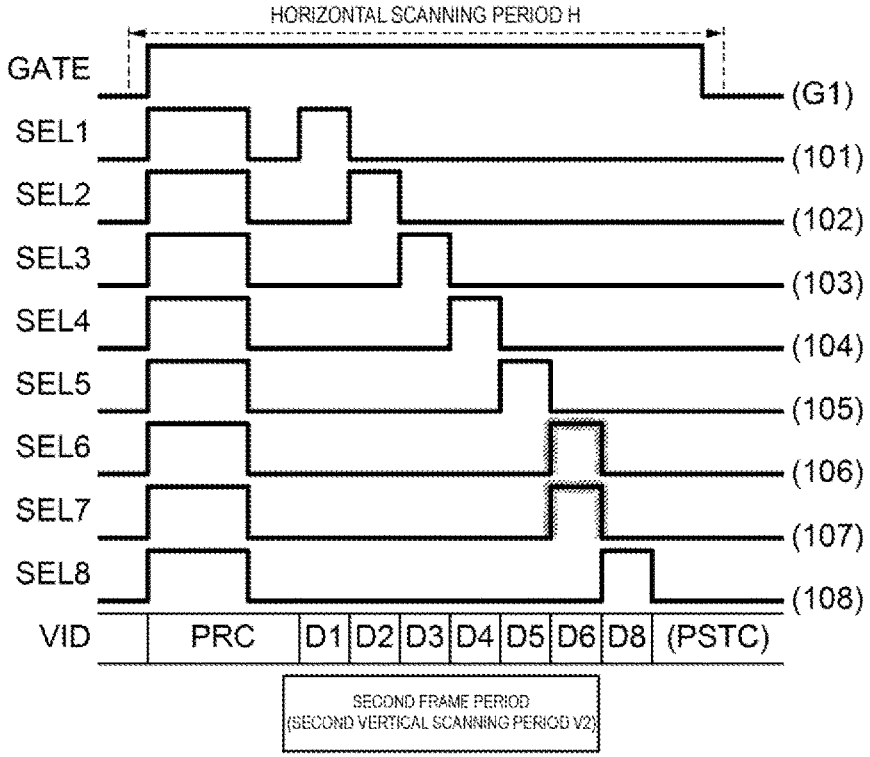
FIG. 5B is a timing chart illustrating the driving method for the electro-optical device.

As illustrated in FIG. 5B, the driving method of the second frame period (second vertical scanning period V2) is to supply the sixth selection signal SEL6 to the sixth selection signal line 106 and the seventh selection signal SEL7 to the seventh selection signal line 107, and to simultaneously select the sixth signal line S6 and the seventh signal line S7. Then, the sixth image signal D6, which is the same image signal D, for example, is supplied to the selected sixth signal line S6 and seventh signal S7. As described above, the image signal D to be supplied is not limited to the sixth image signal D6, and may be the seventh image signal D7. Hereinafter, in the second frame period, each horizontal scanning period H is driven in the same manner.

As shown in FIG. 6B, the gradation distribution of the second frame period is such that, both the gradations of the sixth pixel 21*f* to which the sixth image signal D6 are written from the sixth signal line S6, and the gradations of the seventh pixel 21*g* to which the sixth image signal D6 are written from the seventh signal line S7, become 180 gradations. Hereinafter, the same gradation display in the column direction (H1 to H8) of the display region 42 is shown by being driven in the same manner.

Also in this case, similar to the first frame period, the selecting period can be shortened by one period, and the same image signal D is supplied to the two adjacent signal lines 23, thus, the gradation distribution does not change greatly around the periphery, and deterioration of the image can be suppressed.

Furthermore, as compared to the first frame period, the simultaneously selected pixels 21 are shifted adjacent (left side in the present embodiment), thus, a same gradation region can be dispersed without concentration of a same gradation on a part of the display screen, and deterioration of the display image can be suppressed. That is, by suppressing the generation of vertical stripes due to the same gradation on a part of the display screen being repeatedly displayed from the first frame period to the second frame period, and the deterioration of the resolution due to the same image signal D (seventh image signal D7) being written to the seventh pixel 21*g* and the eighth pixel 21*h*, it is possible to provide an electro-optical device and a driving method for the electro-optical device that can accommodate high resolution and high speed driving while suppressing deterioration of image quality.

Figure 5C:
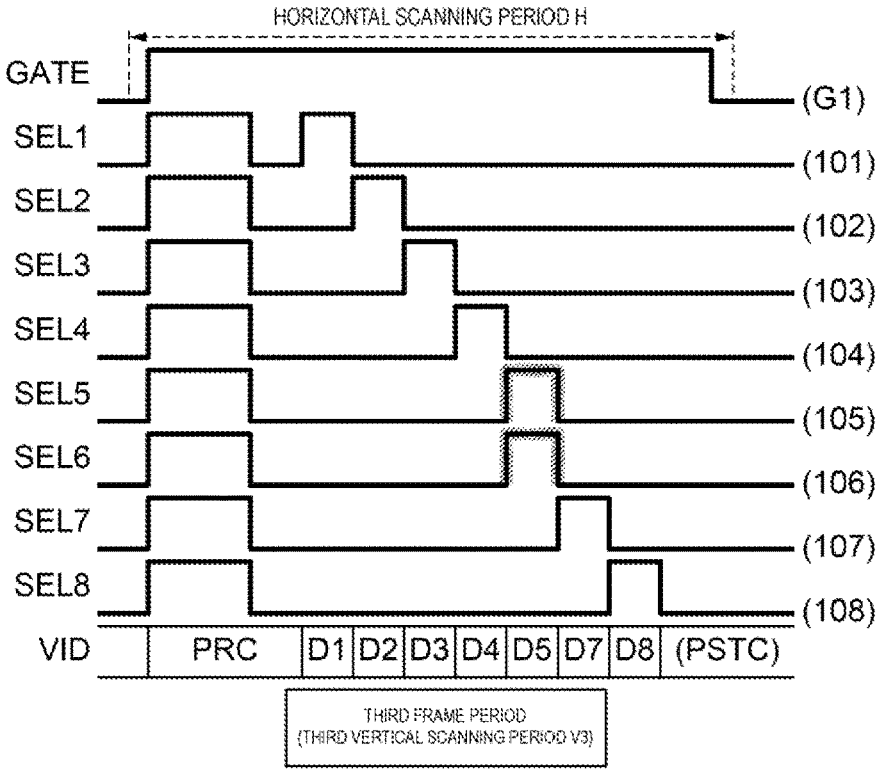
FIG. 5C is a timing chart illustrating the driving method for the electro-optical device.

As illustrated in FIG. 5C, the driving method of the third frame period (third vertical scanning period V3) is to supply the fifth selection signal SEL5 to the fifth selection signal line 105 and the sixth selection signal SEL6 to the sixth selection signal line 106, and to simultaneously select the fifth signal line S5 and the sixth signal line S6. Then, the fifth image signal D5, which is the same image signal D, for example, is supplied to the selected fifth signal line S5 and sixth signal line S6. Hereinafter, in the third frame period, each horizontal scanning period H is driven in the same manner.

As shown in FIG. 6C, the gradation distribution of the third frame period is such that, both the gradations of the fifth pixel 21*e* to which the fifth image signal D5 are written from the fifth signal line S5, and the gradations of the sixth pixel 21*f* to which the fifth image signal D5 are written from the sixth signal line D5, become 160 gradations. Hereinafter, the same gradation display in the column direction (H1 to H8) of the display region 42 is shown by being driven in the same manner.

Figure 5D:
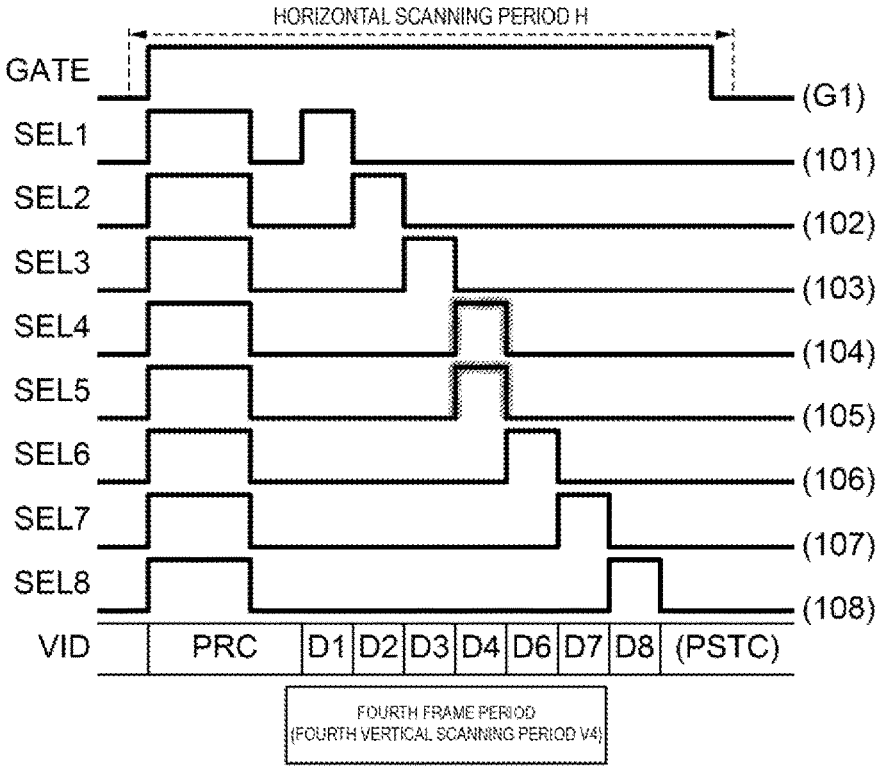
FIG. 5D is a timing chart illustrating the driving method for the electro-optical device.

As illustrated in FIG. 5D, the driving method of the fourth frame period (fourth vertical scanning period V4) is to supply the fourth selection signal SEL4 to the fourth selection signal line 104 and the fifth selection signal SEL5 to the fifth selection signal line 105, and to simultaneously select the fourth signal line S4 and the fifth signal S5. Then, the fourth image signal D4, which is the same image signal D, for example, is supplied to the selected fourth signal line S4 and fifth signal line S5. Hereinafter, in the fourth frame period, each horizontal scanning period H is driven in the same manner.

As shown in FIG. 6D, the gradation distribution of the fourth frame period is such that, both the gradations of the fourth pixel 21*e* to which the fourth image signal D4 are written from the fourth signal line S4, and the gradations of the fifth pixel 21*e* to which the fourth image signal D4 are written from the fifth signal line S5, become 140 gradations. Hereinafter, the same gradation display in the column direction (H1 to H8) of the display region 42 is shown by being driven in the same manner.

In this way, the simultaneously selected pixels 21 are shifted in the adjacent direction (left side in the present embodiment) from the first frame period to the fourth frame period, thus, a same gradation region can be dispersed without the concentration of a same gradation on a part of the display screen, and deterioration of the display image can be suppressed. That is, by suppressing the generation of vertical stripes due to the same gradation on a part of the display screen being repeatedly displayed from the first frame period to the fourth frame period, and the deterioration of the resolution due to the same image signal D (seventh image signal D7) being written to the seventh pixel 21*g* and the eighth pixel 21*h*, it is possible to provide an electro-optical device and a driving method for the electro-optical device that can accommodate high resolution and high speed driving while suppressing deterioration of image quality.

Figure 5E:
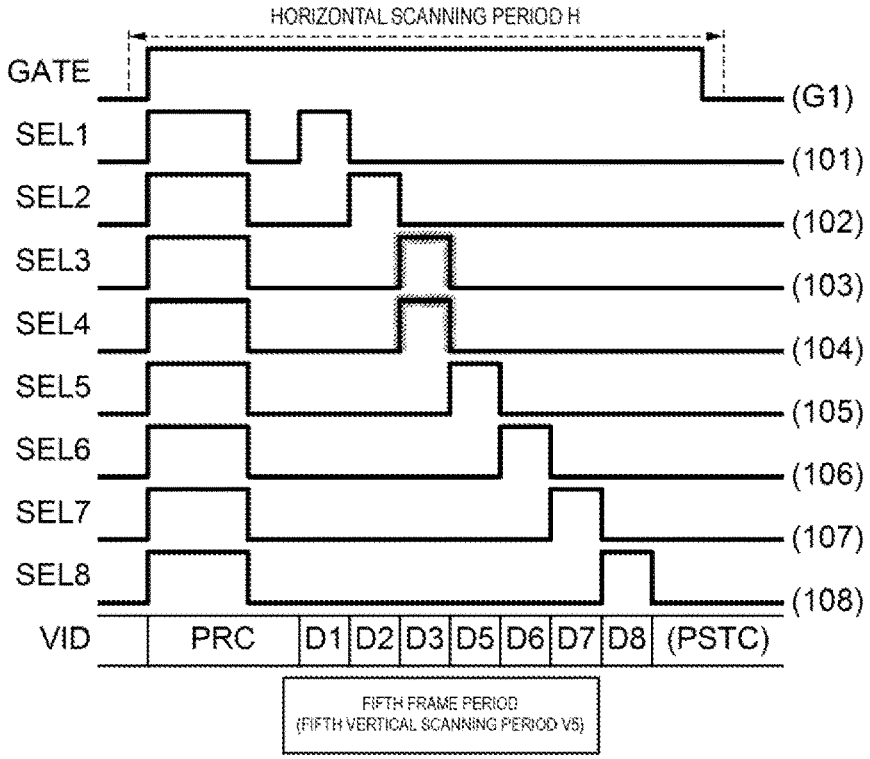
FIG. 5E is a tuning chart illustrating the driving method for the electro-optical device.

As illustrated in FIG. 5E, the driving method of the fifth frame period (fifth vertical scanning period V5) is to supply the third selection signal SEL3 to the third selection signal line 103 and the fourth selection signal SEL4 to the fourth selection signal line 104, and to simultaneously select the third signal line S3 and the fourth signal line S4. Then, the third image signal D3, which is the same image signal D, for example, is supplied to the selected third signal line S3 and the fourth signal line S4. Hereinafter, in the fifth frame period, each horizontal scanning period H is driven in the same manner.

As shown in FIG. 6E, the gradation distribution of the fifth frame period is such that, both the gradations of the third pixel 21*c* to which the third image signal D3 are written from the third signal line S3, and the gradations of the fourth pixel 21*d* to which the third image signal D3 are written from the fourth signal line S4, become 120 gradations. Hereinafter, the same gradation display in the column direction (H1 to H8) of the display region 42 is shown by being driven in the same manner.

Figure 5F:
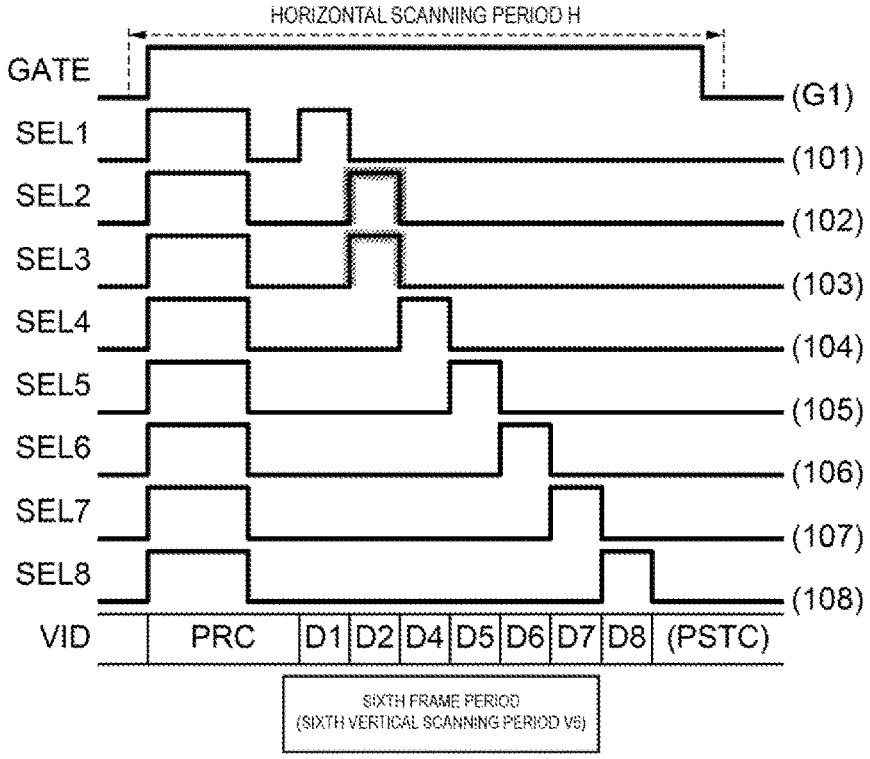
FIG. 5F is a timing chart illustrating the driving method for the electro-optical device.

As illustrated in FIG. 5F, the driving method of the sixth frame period (sixth vertical scanning period V6) is to supply the second selection signal SEL2 to the second selection signal line 102 and the third selection signal SEL3 to the third selection signal line 103, and to simultaneously select the second signal line S2 and the third signal line S3. Then, the second image signal D2, which is the same image signal D, for example, is supplied to the selected second signal line S2 and the third signal line S3. Hereinafter, in the sixth frame period, each horizontal scanning period H is driven in the same manner.

As shown in FIG. 6F, the gradation distribution of the sixth frame period is such that, both the gradations of the second pixel 21*b* to which the second image signal D2 are written from the second signal line D2, and the gradations of the third pixel 21*c* to which the second image signal D2 are written from the third signal line S3, become 100 gradations. Hereinafter, the same gradation display in the column direction (H1 to H8) of the display region 42 is shown by being driven in the same manner.

Figure 5G:
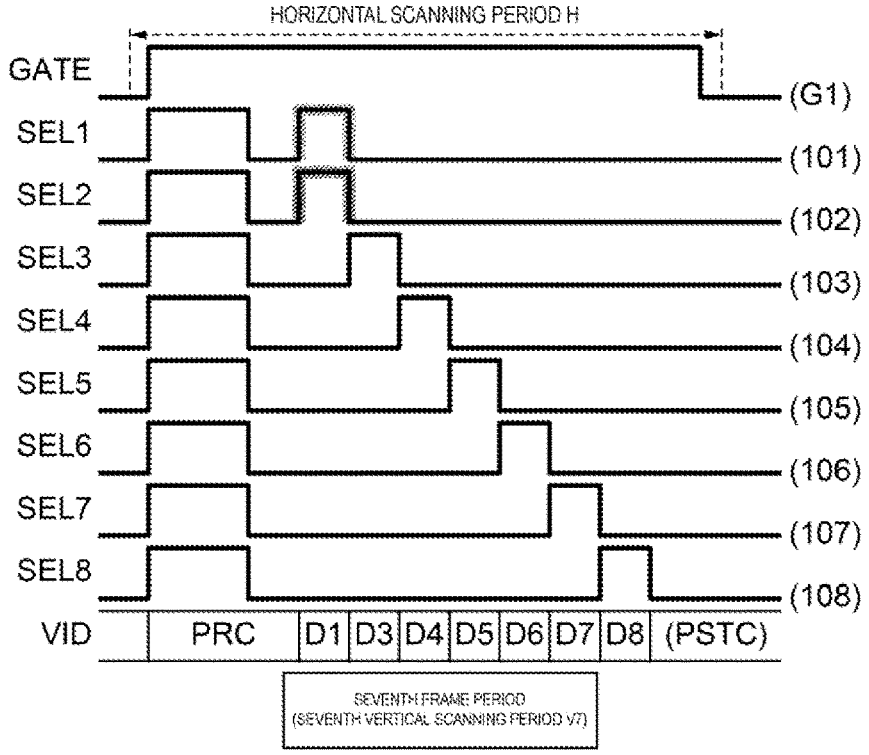
FIG. 5G is a timing chart illustrating the driving method for the electro-optical device.

As illustrated in FIG. 5G, the driving method of the seventh frame period (seventh vertical scanning period V7) is to supply the first selection signal SEL1 to the first selection signal line 101 and the second selection signal SEL2 to the second selection signal line 102, and to simultaneously select the first signal line S1 and the second signal line S2. Then, the first image signal D1, which is the same image signal D, for example, is supplied to the selected first signal line S1 and the second signal line S2. Hereinafter, in the seventh frame period, each horizontal scanning period H is driven in the same manner.

As shown in FIG. 6G, the gradation distribution of the seventh frame period is such that, both the gradations of the first pixel 21*a* to which the first image signal D1 are written from the first signal line S1, and the gradations of the second pixel 21*b* to which the first image signal D1 are written from the second signal line S2, become 80 gradations. Hereinafter, the same gradation display in the column direction (H1 to H8) of the display region 42 is shown by being driven in the same manner.

Figure 5H:
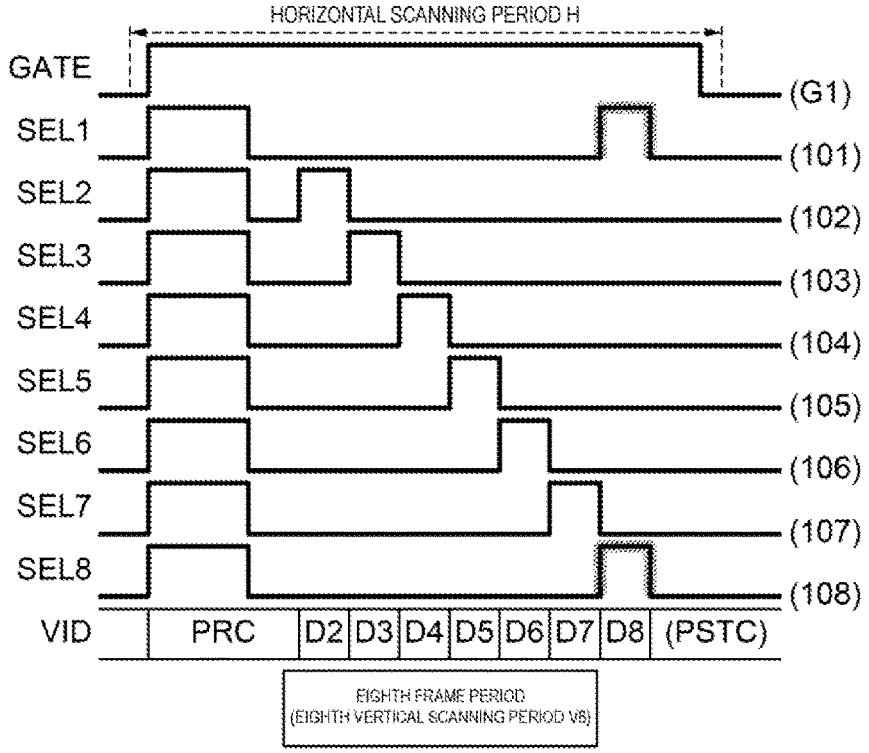
FIG. 5H is a timing chart illustrating the driving method for the electro-optical device.

As illustrated in FIG. 5H, in the driving method of the eighth frame period (eighth vertical scanning period V8) is to supply the eighth selection signal SEL8 to the eighth selection signal line 108 and the first selection signal SEL1 to the first selection signal line 101, and to simultaneously select the eighth signal line S8 and the first signal line S1.

Note that, the eighth signal line S8 described here is a signal line adjacent to the first signal line S1, thus refers to the eighth signal line S8 of the block of the adjacent signal lines. Specifically, for example, the eighth signal line S8 may be electrically coupled to the 0th image signal line OS0 arranged adjacent to the first image signal line OS1.

Then, the eighth image signal D8, which is the same image signal D, for example, is supplied to the selected eighth signal line S8 and first signal line S1. Hereinafter, in the eighth frame period, each horizontal scanning period H is driven in the same manner.

As shown in FIG. 6H, the gradation distribution of the eighth frame period is such that, both the gradations of the eighth pixel 21*h* to which the eighth image signal D8 are written from the eighth signal line S8, and the gradations of the first pixel 21*a* to which the eighth image signal D8 are written from the first signal line S1, become 60 gradations.

Note that, in the gradation distribution shown in FIG. 6H, although the gradation of the eighth pixel 21*h* electrically coupled to the 0th image signal line OS0 adjacent to the first image signal line OS1 is not displayed, it is 60 gradations. Hereinafter, in the eighth frame period, each horizontal scanning period H is driven in the same manner.

In this way, the simultaneously selected pixels 21 are shifted in the adjacent direction (left side in the present embodiment) from the fifth frame period to the eighth frame period, thus, a same gradation region can be dispersed without concentration of a same gradation on a part of the display screen, and deterioration of the display image can be suppressed. That is, by suppressing the generation of vertical stripes due to the same gradation on a part display screen being repeatedly displayed from the first frame period to the fourth frame period, and the deterioration of the resolution due to the same image signal D (third image signal D3) being written to the third pixel 21*c* and the fourth pixel 21*d*, it is possible to provide a driving method that can accommodate high resolution and high speed driving while suppressing deterioration of image quality.

As described above, according to the electro-optical device 20, the driving method for the electro-optical device 20 and the electronic apparatus according to the First Exemplary Embodiment, the following effects can be obtained.

(1) According to First Exemplary Embodiment, the two adjacent signal lines 23 are simultaneously selected to supply the same image signal D, thus, as compared to a case where one signal line 23 is selected to supply the image signal D, the selecting period (time) can be shortened by one period. In addition, the same image signal D is written to adjacent pixels coupled to the two adjacent signal lines 23, thus the gradation difference between the adjacent pixels 21 can be reduced, and deterioration of the display image can be suppressed. As a result, the time of writing the image signal D to the signal line 23 can be secured, and high-resolution display quality can be provided. Specifically, for example, brightness and image quality can be improved by increasing the writing time as much as reducing the number of times of writing. Furthermore, by increasing the drive frequency as much as reducing the number of times of writing, it is possible to easily achieve high resolution and high speed driving.

(2) According to First Exemplary Embodiment, the combination of the signal lines 23 to which the same image signal D is supplied is changed for each frame period, the position of the pixels 21 having the same gradation can be shifted. Specifically, the position of adjacent pixels 21 performing the same gradation display are not fixed in the display region 42, thus deterioration of image quality can be suppressed.

Second Exemplary Embodiment

Driving Method for Electro-Optical Device

FIG. 7A to FIG. 7D are timing charts illustrating a driving method for an electro-optical device according to Second Exemplary Embodiment. FIGS. 8A to 8D are tables showing gradations for each frame period. A driving method for the electro-optical device according to Second Exemplary Embodiment will be described below with reference to FIGS. 7A to 7D and FIGS. 8A to 8D.

In the driving method of First Exemplary Embodiment described above, in the demultiplexer circuit, one set of two adjacent signal lines 23 is selected, and the same image signal D is supplied to the two selected signal lines 23. In contrast, the driving method of Second Exemplary Embodiment differs in that, in the demultiplexer circuit, portions where two sets of two adjacent signal lines 23 are selected. The other portions are substantially the same as those of First Exemplary Embodiment, and therefore, in Second Embodiment, portions different from those of First Exemplary Embodiment will be described in detail, and descriptions of other overlapping portions be omitted as appropriate. Note that in Second Exemplary Embodiment, the drive frequency S (S is a multiple of 60) is 240 Hz (four-time speed driving).

Figure 7A:
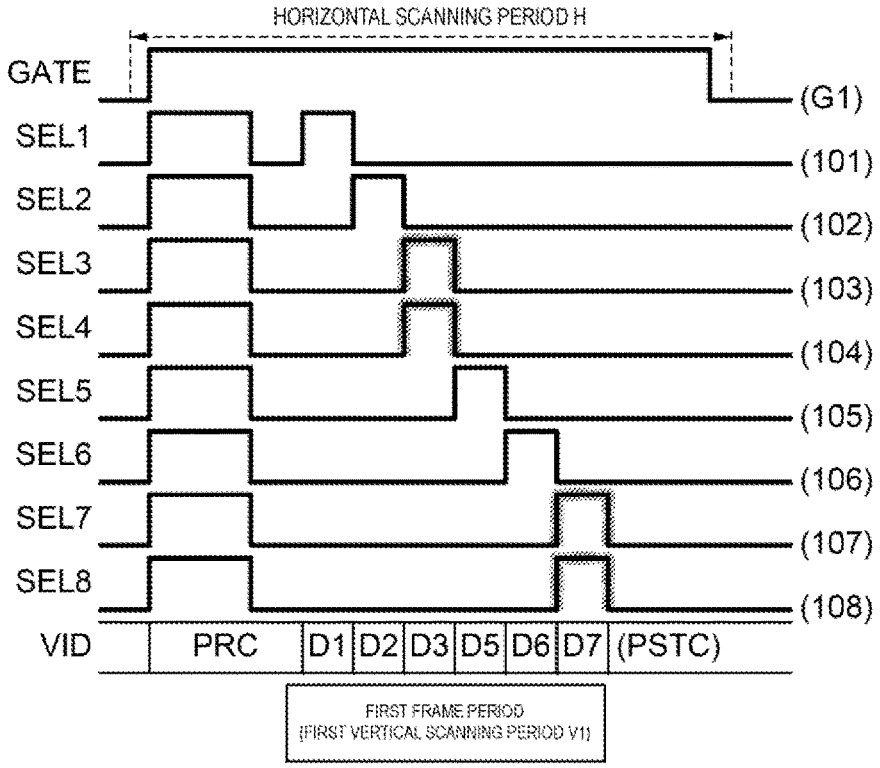
FIG. 7A is a timing chart illustrating a driving method for an electro-optical device according to Second Exemplary Embodiment.

As described above, in the driving method of Second Exemplary Embodiment, the combination of the simultaneously selected signal lines 23 is set in two sets. Specifically, as illustrated in FIG. 7A, in the first frame period (first vertical scanning period V1), the third selection signal SEL3 is supplied to the third selection signal line 103, the fourth selection signal SEL4 is supplied to the fourth selection signal line 104, and the third signal line S3 and the fourth signal line S4 (first signal line group) are simultaneously selected.

Then, the third image signal D3 (first image signal), which is the same image signal D, for example, is supplied to the simultaneously third selected signal line S3 and the fourth signal line S4. This is the combination of a first set of signal lines 23. Next, a combination of a second set of signal lines 23 will be described.

In the second set, similar in the first frame period, the seventh selection signal SEL7 is supplied to the seventh selection signal line 107, the eighth selection signal SEL8 is supplied to the eighth selection signal line 108, and the seventh signal line S7 and the eighth signal line S8 (second signal line group) are simultaneously selected. Then, the seventh image signal D7 (second image signal), which is the same image signal D, for example, is supplied to the simultaneously selected seventh signal line S7 and the eighth signal line S8.

In this way, the third image signal D3 is written to both the third pixel 21*c* and the fourth pixel 21*d*. On the other hand, the seventh image signal D7 is written to both the seventh pixel 21*g* and the eighth pixel 21*h*. Hereinafter, in the first frame period, each horizontal scanning period H is driven in the same manner.

As described above, by configuring the combination of the simultaneously selected two signal lines 23 into two sets, the selecting period can be shortened by two periods as compared with First Exemplary Embodiment. As a result, the writing time to the pixel 21 can be further secured. Accordingly, it is possible to suppress the influence of leakage current, and to improve the brightness.

As shown in FIG. 8A, the gradation distribution of the first frame period is such that, both the gradations of the third pixel 21*c* to which the third image signal D3 are written from the third signal line S3, and the gradations of the fourth pixel 21*d* to which the third image signal D3 are written from the fourth signal line S4, become 120 gradations.

In addition, both the gradations of the seventh pixel 21*g* to which the seventh image signal D7 are written from the seventh signal line S7, and the gradations of the eighth pixel 21*h* to which the seventh image signal D7 are written from the eighth signal line S8, become 200 gradations. Hereinafter, the same gradation display in the column direction (H1 to H8) of the display region 42 is shown by being driven in the same manner.

Figure 7B:
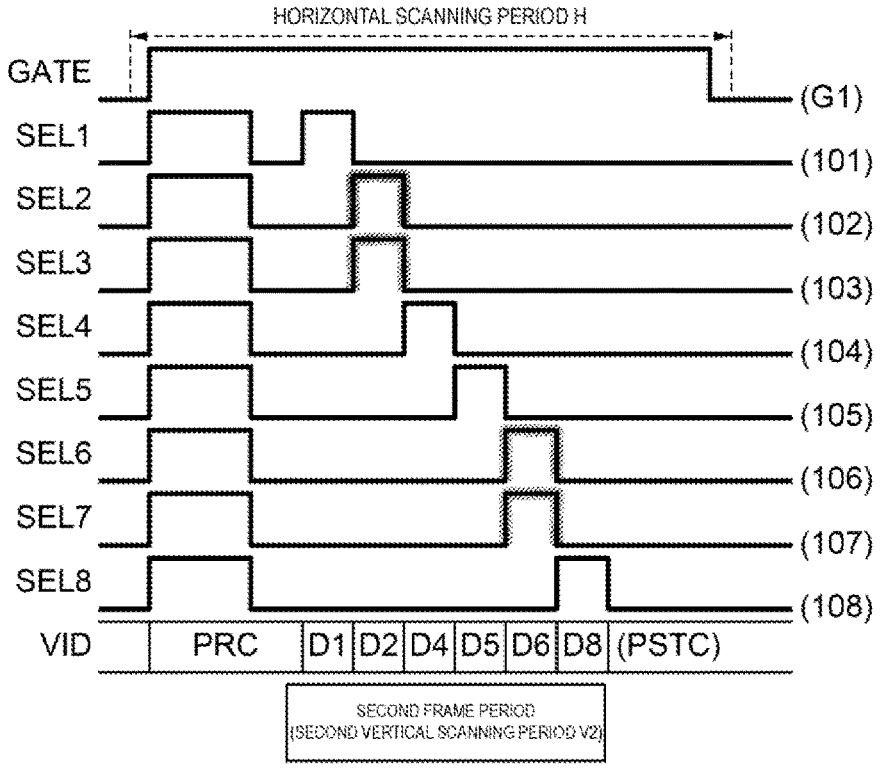
FIG. 7B is a timing chart illustrating the driving method for the electro-optical device.

As illustrated in FIG. 7B, the driving method for the second frame period (second vertical scanning period V2) is to supply the second selection signal SEL2 to the second selection signal line 102 and the third selection signal SEL3 to the third selection signal line 103, and to simultaneously select the second signal line S2 and the third signal line S3. Then, the second image signal D2, which is the same image signal D, for example, is supplied to the selected second signal line S2 and the third signal line S3.

Further, the sixth selection signal SEL6 is supplied to the sixth selection signal lint 106, the seventh selection signal SEL7 is supplied to the seventh selection signal line 107, and the sixth signal line S6 and the seventh signal line S7 are simultaneously selected. Then, the sixth image signal D6, which is the same image signal D, for example, is supplied to the selected sixth signal line S6 and seventh signal line S7. Hereinafter, in the second frame period, each horizontal scanning period H is driven in the same manner.

As shown in FIG. 8B, the gradation distribution of the second frame period is such that, both the gradations of the second pixel 21*b* to which the second image signal D2 are written from the second signal line S2, and the gradations of the third pixel 21*c* to which the second image signal D2 are written from the third signal line S3, become 100 gradations.

In addition, both the gradations of the sixth pixel 21*f* to which the sixth image signal D6 are written from the sixth signal line S6, and the gradations of the seventh pixel 21*g* to which the sixth image signal D6 are written the seventh signal line S7, become 180 gradations. Hereinafter, the same gradation display in the column direction (H1 to H8) of the display region 42 is shown by being driven in the same manner.

Figure 7C:
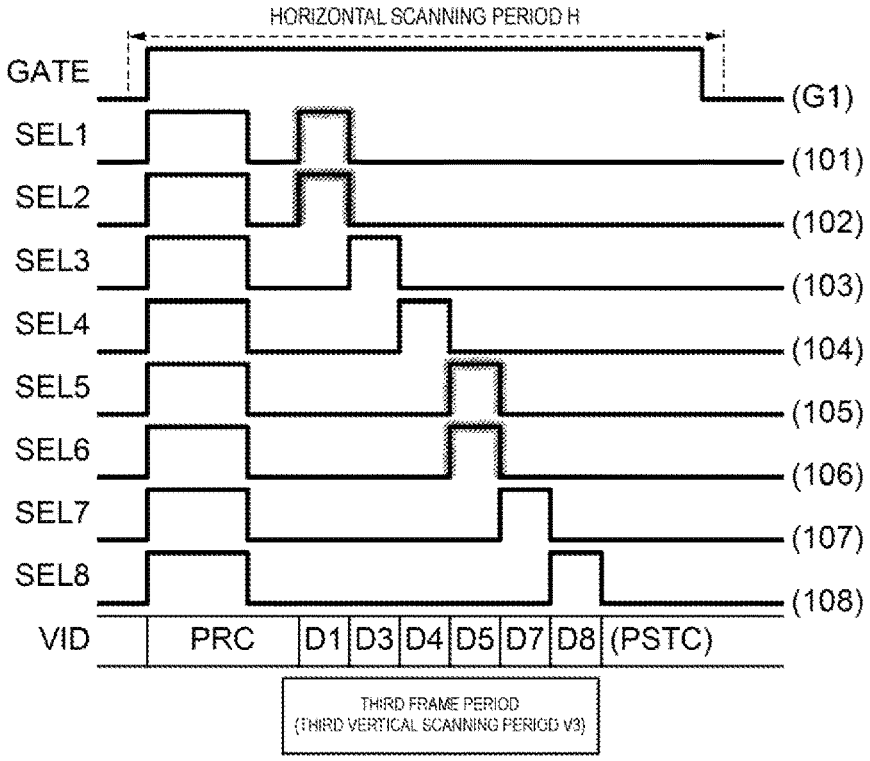
FIG. 7C is a timing chart illustrating the driving method for the electro-optical device.

As illustrated in FIG. 7C, the driving method of the third frame period (third vertical scanning period V3) is to supply the first selection signal SEL1 to the first selection signal line 101 and the second selection signal SEL2 to the second selection signal line 102, and to simultaneously select the first signal line S1 and the second signal line S2. Then, the first image signal D1, which is the same image signal D, for example, is supplied to the selected first signal line S1 and the second signal line S2.

In addition, the fifth selection signal SEL5 is supplied to the fifth selection signal line 105, the sixth selection signal SEL6 is supplied to the sixth selection signal line 106, and the fifth signal line S5 and the sixth signal line S6 are simultaneously selected. Then, the fifth image signal D5, which is the same image signal D, for example, is supplied to the simultaneously selected fifth signal line S5 and sixth signal line S6. Hereinafter, in the third frame period, each horizontal scanning period H is driven in the same manner.

As shown in FIG. 8C, the gradation distribution for the third frame period is such that, both the gradations of the first pixel 21*a* to which the first image signal D1 are written from the first signal line S1, and the gradations of the second pixel 21*b* to which the first image signal D1 are written from the second signal line S2, become 80 gradations.

In addition, both the gradations of the fifth pixel 21*e* to which the fifth image signal D5 are written from the fifth signal line S5, and the gradations of the sixth pixel 21*f* to which the fifth image signal D5 are written from the sixth signal line S6, become 160 gradations. Hereinafter, the same gradation display in the column direction (H1 to H8) of the display region 42 is shown by being driven in the same manner.

Figure 7D:
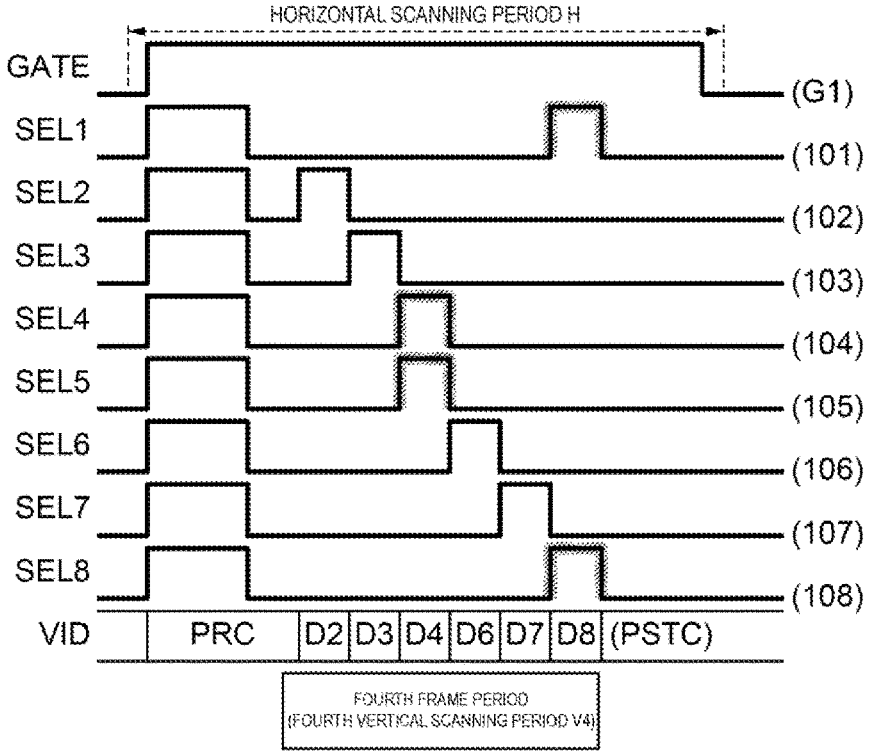
FIG. 7D is a timing chart illustrating the driving method for the electro-optical device.

As illustrated in FIG. 7D, the driving method for the fourth frame period (fourth vertical scanning period V4) is to supply the eighth selection signal SEL8 to the eighth selection signal line 108 and the first selection signal SEL1 to the first selection signal line 101, and to simultaneously select the eighth signal line S8 and the first signal line S1. Then, the eighth image signal D8, which is the same image signal D, for example, is supplied to the selected eighth signal line S8 and first signal line S1. Note that the eighth signal line S8 is electrically coupled to the 0th image signal line OS0.

Furthermore, the fourth selection signal SEL4 is supplied to the fourth selection signal line 104, the fifth selection signal SEL5 is supplied to the fifth selection signal line 105, and the fourth signal line S4 and the fifth signal line S5 are simultaneously selected. Then, the fourth image signal D4, which is the same image signal D, for example, is supplied to the simultaneously selected fourth signal line S4 and the fifth signal line S5. Hereinafter, in the fourth frame period, each horizontal scanning period H is driven in the same manner.

As shown in FIG. 8D, the gradation distribution of the fourth frame period is such that, both the gradations of the eighth pixel 21*h* to which the eighth image signal D8 are written from the eighth signal line S8 and the gradations of the first pixel 21*a* to which the eighth image signal D8 are written from the first signal line S1 become 60 gradations (the illustration of 60 gradations of the eighth pixel 21*h* is omitted).

In addition, both the gradations of the fourth pixel 21*d* to which the fourth image signal D4 are written from the fourth signal line S4 and the gradations of the fifth pixel 21*e* to which the fourth image signal D4 are written from the fifth signal line S4 become 140 gradations. Hereinafter, the same gradation display in the column direction (H1 to H8) of the display region 42 is shown by being driven in the same manner.

As described above, according to the driving method of the electro-optical device 20 of Second Exemplary Embodiment, the following effects can be obtained.

(3) According to Second Exemplary Embodiment, the two signal lines 23 of the first set are simultaneously selected to supply the same image signal D, and the two signal lines 23 of the second set are simultaneously selected to supply the same image signal D, thus the selecting period can be shortened by two periods. Therefore, the writing period to the pixels 21 can be shortened, thus the writing period to the pixels 21 can be easily secured within the limited horizontal scanning period H. Further, the horizontal scanning period H can be shortened, thus, it is possible to easily accommodate high resolution and high speed driving by increasing the drive frequency. Further, the simultaneously selected pixels 21 are shifted adjacent (left side in the present embodiment) from the first frame period to the fourth frame period, thus, a same gradation region can be dispersed without concentration of a same gradation on a part of the display screen, and deterioration of the display image can be suppressed. That is, by suppressing the generation of the vertical stripes due to the same gradation on a part of the display screen being repeatedly displayed from the first frame period to the fourth frame period, and the deterioration of resolution due to the same image signal D (the third image signal D3 and the seventh image signal D7) being written to the third pixel 21*c* and the fourth pixel 21*d*, and the seventh pixel 21*g* and the eighth pixel 21*h*, respectively, it is possible to provide an electro-optical device and a driving method for the electro-optical device that can accommodate high resolution and high speed driving while suppressing deterioration of image quality.

Third Exemplary Embodiment

Driving Method for Electro-Optical Device

Figure 9:
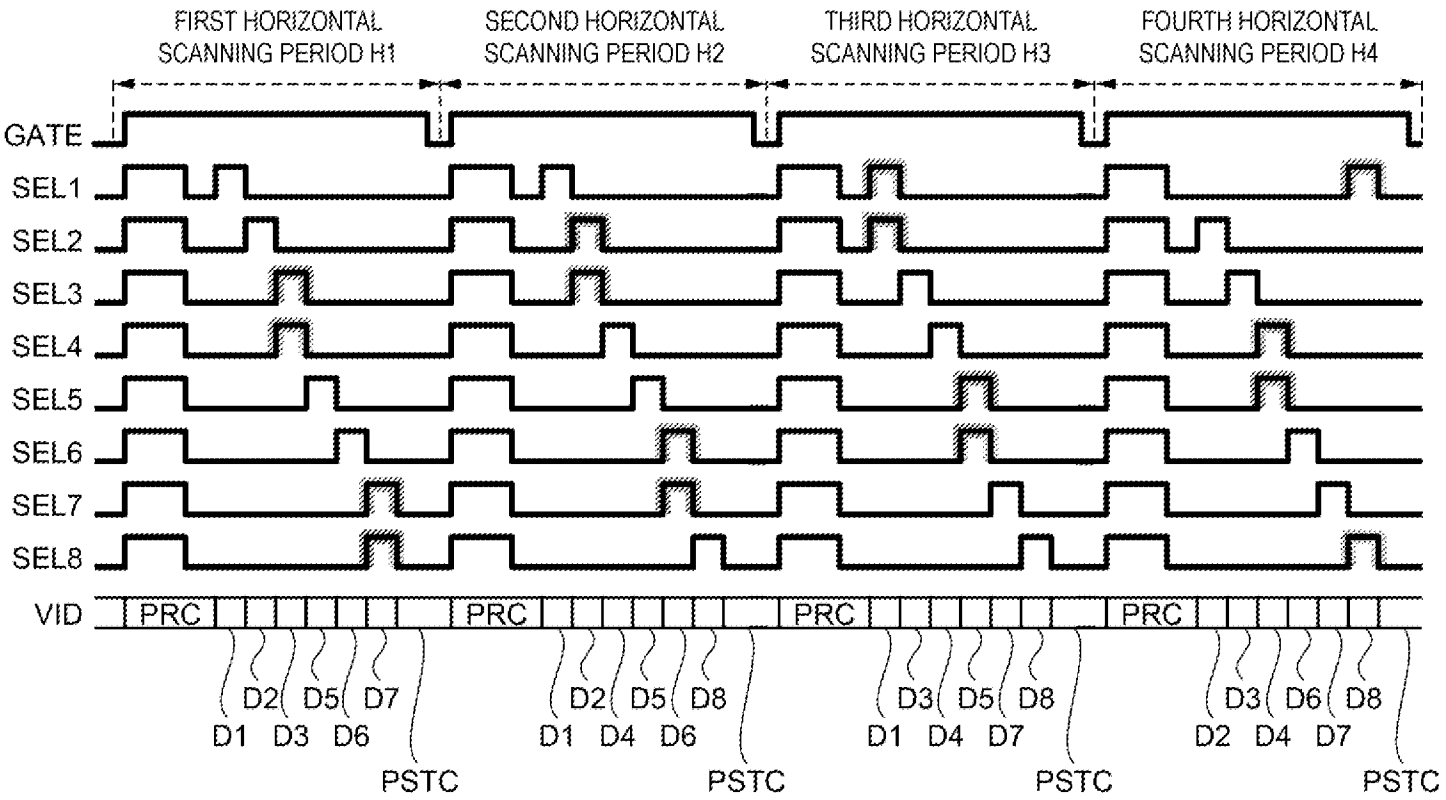
FIG. 9 is a timing chart illustrating a driving method for an electro-optical device according to Third Exemplary Embodiment.

FIG. 9 is a timing chart illustrating a driving method for an electro-optical device according to Third Exemplary Embodiment. FIGS. 10A to 10D are tables showing gradations for each frame period. A driving method for the electro-optical device according to Third Exemplary Embodiment will be described below with reference to FIG. 9 and FIGS. 10A to 10D.

In the driving method according to Second Exemplary Embodiment described above, in the demultiplexer circuit, two sets of the two adjacent signal lines 23 are selected, and further, the signal lines 23 that combine in each frame period from the first frame period to the fourth frame period and from the fifth frame period to the eighth frame period are changed. In contrast, the driving method of Third Exemplary Embodiment differs in that, in the demultiplexer circuit, in addition to the driving method of Second Exemplary Embodiment, the portions where the combination of the simultaneously selected signal lines 23 for each horizontal scanning period H configuring one frame period is changed. In other words, the combination of simultaneously selected signal lines is rotated within one frame period. In this way, the combination of signal lines 23 that are simultaneously selected for each horizontal scanning period H is changed, thus deterioration of the image in one frame can be suppressed without generating the vertical stripes. The other portions are substantially the same as those of Second Exemplary Embodiment, and therefore, in Third Exemplary Embodiment, portions different from those of Second Exemplary Embodiment will be described in detail, and descriptions of other overlapping portions will be omitted as appropriate.

In the driving method of Third Exemplary Embodiment, as described above, the simultaneously selected signal lines 23 is changed for each horizontal scanning period H (first horizontal scanning period H1, second horizontal scanning period H2, third horizontal scanning period H3, and fourth horizontal scanning period H4) which configures the frazzle period. Specifically, as illustrated FIG. 9, in the first horizontal scanning period H1 of the first frame period, the third signal line S3 and the fourth signal line S4 are simultaneously selected, and the same third image signal D3 is supplied to both the third signal S3 and the fourth signal line S4.

Further, in the same first horizontal scanning period H1, the seventh signal line S7 and the eighth signal line S8 are simultaneously selected, and the same seventh image signal D7 is supplied to both the selected seventh signal line S7 and the eighth signal line S8.

As shown in FIG. 10A, the gradation distribution of the first horizontal scanning period H1 is such that, both the gradations of the third pixel 21*c* to which the third image signal D3 are written from the third signal line S3 and the gradations of the fourth pixel 21*d* to which the third image signal D3 are written from the fourth signal line S4 become 120 gradations.

In addition, both the gradations of the seventh pixel 21*g* to which the seventh image signal D7 are written from the seventh signal line S7, and the gradations of the eighth pixel 21*h* to which the seventh image signal D7 are written from the eighth signal line S8, become 200 gradations.

Next, as illustrated in FIG. 9, in the second horizontal scanning period H2 of the first frame period, the second signal line S2 and the third signal line S3 are simultaneously selected, and the same second image signal D2 is supplied to both the selected second signal line S2 and the third signal line S3.

Further, in the second horizontal scanning period H2, the sixth signal line S6 and the seventh signal line S7 are simultaneously selected, and the same sixth image signal D6 is supplied to both the selected sixth signal line S6 and the seventh signal line S7.

As shown in FIG. 10A, the gradation distribution of the second horizontal scanning period H2 is such that, both the gradations of the second pixel 21*b* to which the second image signal D2 are written via the second signal line S2 and the gradations of the third pixel 21*c* to which the second image signal D2 are written via the third signal line S3 become 100 gradations.

Further, both the gradations of the sixth pixel 21*f* to which the sixth image signal D6 are written via the sixth signal line S6 and the gradations of the seventh pixel 21*g* to which the sixth image signal D6 are written via the seventh signal line S7 become 180 gradations.

Next, as illustrated in FIG. 9, in the third horizontal scanning period H3 of the first frame period, the first signal line S1 and the second signal line S2 are simultaneously selected, and the same first image signal D is supplied to both the selected first signal line S1 and the second signal line S2.

In addition, in the third horizontal scanning period H3, the fifth signal line S5 and the sixth signal line S6 are simultaneously selected, and the same fifth image signal D5 is supplied to both the selected fifth signal line S5 and sixth signal line S6.

As shown in FIG. 10A, the gradation distribution of the third horizontal scanning period H3 is such that, both the gradations of the first pixel 21*a* to which the first image signal D1 are written via the first signal line S1 and the gradations of the second pixel 21*b* to which the first image signal D1 are written via the second signal line S2, become 80 gradations.

In addition, both the gradations of the fifth pixel 21*e* to which the fifth image signal D5 are written via the fifth signal line S5 and the gradations of the sixth pixel 21*f* to which the fifth image signal D5 are written via the sixth signal line S6 become 160 gradations.

Next, as illustrated in FIG. 9, in the fourth horizontal scanning period H4 in the first frame period, the eighth signal line S8 and the first signal line S1 are selected, and the same eighth image signal D8 is supplied to both the selected eighth signal line S8 and the first signal line S1.

Note that, the eighth signal line S8 described here is a signal line adjacent to the first signal line S1, thus refers to the eighth signal line S8 of the block of the adjacent signal lines. Specifically, for example, the eighth signal line S8 may be electrically coupled to the 0th image signal line OS0 adjacent to the first image signal line OS1.

Further, in the fourth horizontal scanning period H4, the fourth signal line S4 and the fifth signal line S5 are simultaneously selected, and the same fourth age signal D4 is supplied to both the selected fourth signal line S4 and the fifth signal line S5.

As shown in FIG. 10A, the gradation distribution of the fourth horizontal scanning period H4 is such that, both the gradations (not illustrated) of the eighth pixel 21*h* to which the eighth image signal D8 are written via the eighth signal line S8, and the gradations of the first pixel 21*a* to which the eighth image signal D8 are written via the first signal line S1, become 60 gradations.

In addition, both the gradations of the fourth pixel 21*d* to which the fourth image signal D4 are written via the fourth signal line S4 and the gradations of the fifth pixel 21*e* to which the fourth image signal D4 are written via the fifth signal line S4 become 140 gradations.

Hereinafter, the same driving is repeated from the first horizontal scanning period H1 to the fourth horizontal scanning period H4 as described above, and the writing of the image signal D to all of the pixels 21 in the first frame period is completed.

In this way, the two adjacent signal lines 23 supplying the same image signal D are made into two sets, and the combination of the two signal lines 23 is changed for each horizontal scanning period H, thus, the positions of adjacent pixels 21 having the same gradation can be dispersed among the screen of one frame. Thus, it is possible to make the deterioration of image quality difficult to be visually recognizable.

Next, a driving method of the second frame period will be described with reference to FIG. 9 and FIG. 10B. As shown in FIG. 10B, the driving method of the second frame period starts in a drive mode of the second horizontal scanning period H2. Hereinafter, driving is performed in an order of a drive mode of the third horizontal scanning period H3, a drive mode of the fourth horizontal scanning period H4, and a drive mode of the first horizontal scanning period H1. Hereinafter, driving is performed in the same order of drive modes, and writing of the image signal D to all of the pixels 21 in the second frame period is completed. The gradation distribution of the second frame period is shown in the table of FIG. 10B.

Next, a driving method of the third frame period will be described. As shown in FIG. 10C, the driving method of the third frame period starts in the drive mode of the third horizontal scanning period H3. Hereinafter, driving is performed in an order of the drive mode of the fourth horizontal scanning period H4, the drive mode of the first horizontal scanning period H1, and the drive mode of the second horizontal scanning period H2, and the writing of the image signal D to all of the pixels 21 in the third frame period is completed. The gradation distribution of the third frame period is shown in the table of FIG. 10C.

Next, a driving method of the fourth frame period will be described. As shown in FIG. 10D, the driving method of the fourth frame period starts in the drive mode of the fourth horizontal scanning period H4. Hereinafter, driving is performed in an order of the drive mode of the first horizontal scanning period H1, the drive mode of the second horizontal scanning period H2, and the drive mode of the third horizontal scanning period H3, and the writing of the image signal D to all of the pixels 21 in the fourth frame period is completed. The gradation distribution of the fourth frame period is shown in the table of FIG. 10D.

As such, by changing the order of the drive modes in each frame period, the positions of adjacent pixels 21 having the same gradation adjacent to each other in each frame can be dispersed. Thus, it is possible to make the deterioration of image quality difficult to be visually recognized.

As described above, according to the driving method of the electro-optical device 20 of the Third Exemplary Embodiment, the following effects can be obtained.

(4) According to the Third Exemplary Embodiment, the combination of the two adjacent signal lines 23 simultaneously selected in each horizontal scanning period H is changed, thus, in one frame (one screen), the positions of the pixels 21 having the same gradation can be shifted in the column direction, and it is possible to make the deterioration of image quality difficult to be visually recognized. Furthermore, the two signal lines 23 simultaneously selected are rotated within one frame period. In this way, the combination of signal lines 23 that are simultaneously selected in each horizontal scanning period H is changed, thus deterioration of the image for one frame period can be suppressed without generating the vertical stripes. Further, the combination of the simultaneously selected two adjacent signal lines 23 is changed in each frame period, thus the positions of the pixels 21 having the same gradation can be shifted in the row direction, and it is possible to make the deterioration of image quality difficult to be recognized.

Fourth Exemplary Embodiment

Driving Method for Electro-Optical Device

Figure 11:
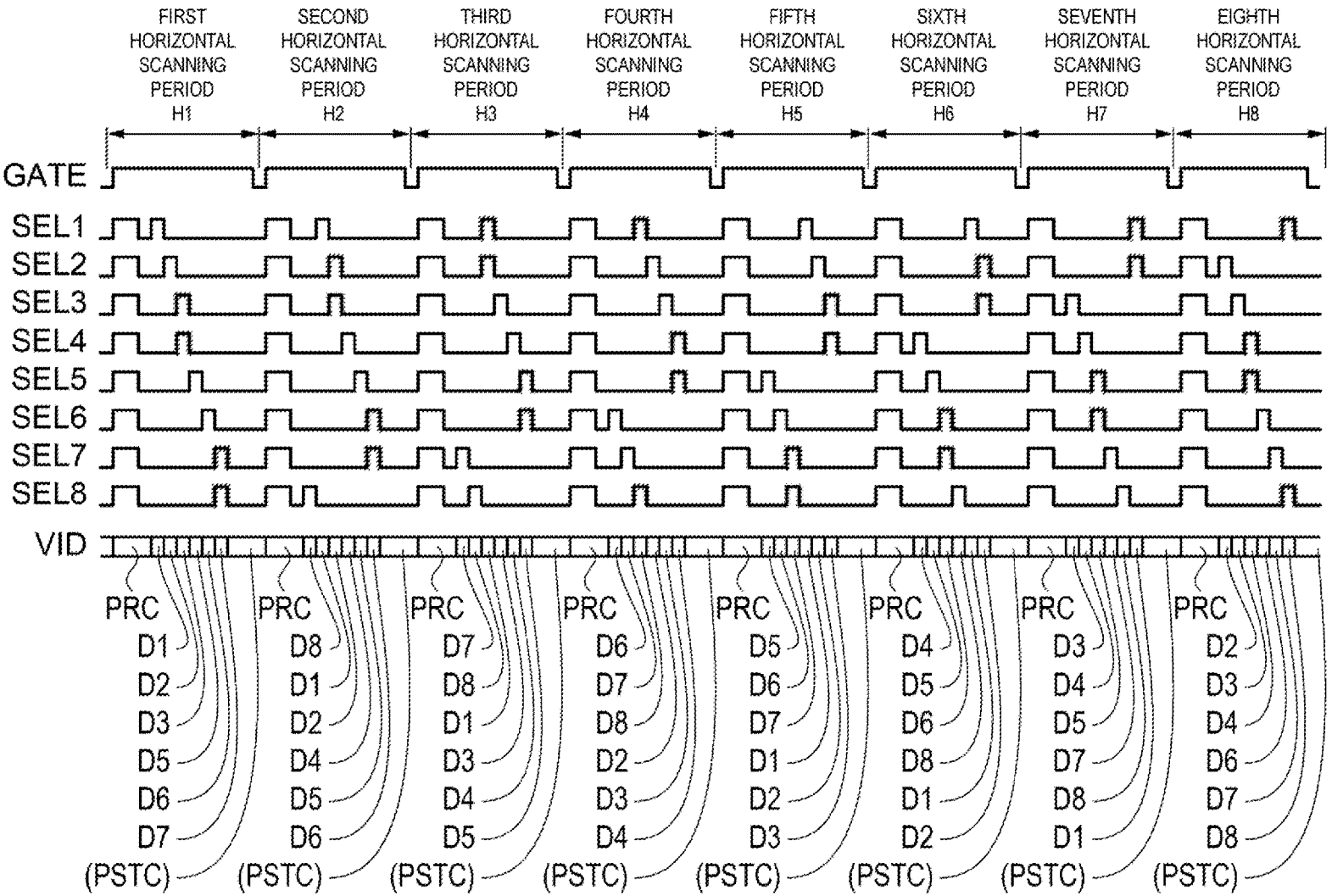
FIG. 11 is a timing chart illustrating a driving method for an electro-optical device according to Fourth Exemplary Embodiment.

FIG. 11 is a timing chart illustrating driving method for an electro-optical device according to Fourth Exemplary Embodiment. FIGS. 12A to 12H are tables showing gradations for each frame period. A driving method for the electro-optical device according to Fourth Exemplary Embodiment will be described below with reference to FIG. 11 and FIGS. 12A to 12H.

In the driving method according to Third Exemplary Embodiment described above, in the demultiplexer circuit, two sets of the two adjacent signal lines 23 are selected, and further, the combination of the signal lines 23 simultaneously selected in each horizontal scanning period H and each frame period is changed. In contrast, the driving method of Fourth Exemplary Embodiment differs in that, in the demultiplexer circuit, portions where the timing of the selection signal SEL supplied to each of the selection signal lines 100 for each horizontal scanning period H is changed. The other portions are substantially the same as those of Third Exemplary Embodiment, and thus, in Fourth Exemplary Embodiment, portions different from those of Third Exemplary Embodiment will be described in detail, and descriptions of other overlapping portions will be omitted as appropriate.

As described above, in the driving method according to Fourth Exemplary Embodiment, the supply order of each selection signal SEL is changed for each horizontal scanning period H. Specifically, the supply is not constantly started from the first selection signal SEL1, but the supply may be started from the second selection signal SEL2, or started from the third selection signal SEL3.

First, as illustrated in FIG. 11, in the first horizontal scanning period H1 of the first frame period, the third signal line S3 and the fourth signal line S4 are simultaneously selected, and the same third image signal D3 is supplied to both the third signal line S3 and the fourth signal line S4.

Further, in the first horizontal scanning period H1, the seventh signal line S7 and the eighth signal line S8 are simultaneously selected, and the same seventh image signal D7 is supplied to both the selected seventh signal line S7 and the eighth signal line S8.

As shown in FIG. 12A, the gradation distribution of the first horizontal scanning period H1 is such that, both the gradations of the third pixel 21*c* to which the third image signal D3 are written from the third signal line S3 and the gradations of the fourth pixel 21*d* to which the third image signal D3 are written from the fourth signal line S4 become 120 gradations.

In addition, both the gradations of the seventh pixel 21*g* to which the seventh image signal D7 are written from the seventh signal line S7, and the gradations of the eighth pixel 21*h* to which the seventh image signal D7 are written from the eighth signal line S8, become 200 gradations. Up to this point is the same as the driving method of Third Exemplary Embodiment.

Next, a driving method of the second horizontal scanning period H2 will be described. First, as illustrated in FIG. 11, after the eighth selection signal SEL8 is supplied and the eighth signal line S8 is selected, the eighth image signal D8 is supplied to the eighth signal line S8. As illustrated in FIG. 12A, the gradations of the eighth pixel 21*h* to which the eighth image signal D8 is written are 220 gradations.

Next, after the first selection signal SEL1 is supplied and the first signal line S1 is selected, the first image signal D1 is supplied to the first signal line S1. As shown in FIG. 12A, the gradations of the first pixel 21*a* to which the first image signal D1 that was written are 80 gradations.

Next, the second selection signal SEL2 and the third selection signal SEL3 are supplied simultaneously, and the same second image signal D2 is supplied to both the selected second signal line S2 and the third signal line S3. As shown in FIG. 12A, the gradations of the second pixel 21*b* and the third pixel 21*c* to which the second image signal D2 is written are the same 100 gradations.

Next, the fourth selection signal SEL4 is supplied to select the fourth signal line S4, and the fourth image signal D4 is written to the fourth pixel 21*d* via the fourth signal line S4. Then, the fifth selection signal SEL5 is supplied to select the fifth signal line S5, and the fifth image signal D5 is written to the fifth pixel 21*e* via the fifth signal line S5.

As shown in FIG. 12A, the gradations of the fourth pixel 21*d* to which the fourth image signal D4 is written are 140 gradations. As shown in FIG. 12A, the gradations of the fifth pixel 21*c* to which the fifth image signal D5 is written are 160 gradations.

Next, the sixth selection signal SEL6 and the seventh selection signal SEL7 are supplied simultaneously, and the same sixth image signal D6 is supplied to both the selected sixth signal line S6 and the seventh signal line S7. As shown in FIG. 12A, the gradations of the sixth pixel 21*f* and the seventh pixel 21*g* to which the sixth image signal D6 is written are the same 180 gradations.

Next, a driving method of the third horizontal scanning period H3 will be described. First, the seventh selection signal SEL7 is supplied to select the seventh signal line S7, and the seventh image signal D7 is written to the seventh pixel 21*g* via the seventh signal line S7. As shown in FIG. 12A, the gradations of the seventh pixel 21*g* are 200 gradations.

Next, the eighth selection signal SEL8 is supplied to select the eighth signal line S8, and the eighth image signal D8 is written to the eighth pixel 21*h* via the eighth signal line S8. As shown in FIG. 12A, the gradations of the eighth pixel 21*h* are 220 gradations.

Next, the first selection signal D1 and the second selection signal SEL2 are supplied simultaneously, and the same first image signal D1 is supplied to both the selected first signal line S1 and the second signal line S2. The gradations of the first pixel 21*a* and the second pixel 21*b* to which the first image signal D1 is written are the same 80 gradations. Thereafter, the image signal D is sequentially written to the third pixel 21*c* to the sixth pixel 21*f*, and the writing operation of the third horizontal scanning period H3 is completed.

In this way, by changing the combination of the simultaneously selected signal lines 23 and changing the order of the selected signal lines 23 for each horizontal scanning period H, regions of adjacent pixels 21 having the same gradation can be dispersed among one frame of image. Thus, it is possible to make the deterioration of image quality difficult to be visually recognizable.

Thereafter, as illustrated in FIG. 11, during the fourth horizontal scanning period H4 to the eighth horizontal scanning period H8, the image signal D is written to the pixels 21 while changing the order of supplying the selection signals SEL. Accordingly, the driving in the first frame period is completed.

As shown in FIG. 12B, the driving method of the second frame period starts in the drive mode of the second horizontal scanning period H2 (see FIG. 11). Hereinafter, driving is performed in an order from the drive mode of the third horizontal scanning period H3 to the drive mode of the first horizontal scanning period H1. The gradation distribution of the second frame period is shown in the table of FIG. 12B.

As shown in FIG. 12C, the driving method of the third frame period starts in the drive mode of the third horizontal scanning period H3 (see FIG. 11). Hereinafter, driving is performed in an order from the drive mode of the fourth horizontal scanning period H4 to the drive mode of the second horizontal scanning period H2. The gradation distribution of the third frame period is shown in the table of FIG. 12C.

As shown in FIG. 12D, the driving method of the fourth frame period starts in the drive mode of the fourth horizontal scanning period H4 (see FIG. 11). Hereinafter, driving is performed in an order from the drive mode of the fifth horizontal scanning period H5 to the drive mode of the third horizontal scanning period H3. The gradation distribution of the fourth frame period is shown in the table of FIG. 12D.

As shown in FIG. 12E, the driving method of the fifth frame period starts in the drive mode of the fifth horizontal scanning period H5 (see FIG. 11). Hereinafter, driving is performed in an order from the drive mode of the sixth horizontal scanning period H6 to the drive mode of the fourth horizontal scanning period H4. The gradation distribution of the fifth frame period is shown in the table of FIG. 12E.

As shown in FIG. 12F, the driving method of the sixth frame period starts in the drive mode of the fifth horizontal scanning period H6 (see FIG. 11). Hereinafter, driving is performed in an order from the drive mode of the seventh horizontal scanning period H7 to the drive mode of the fifth horizontal scanning period H5. The gradation distribution of the sixth frame period is shown in the table of FIG. 12F.

As shown in FIG. 12G, the driving method of the seventh frame period starts in the drive mode of the fifth horizontal scanning period H7 (see FIG. 11). Hereinafter, driving is performed in an order from the drive mode of the eighth horizontal scanning period H8 to the drive mode of the sixth horizontal scanning period H6. The gradation distribution of the seventh frame period is shown in the table of FIG. 12G.

As shown in FIG. 12H, the driving method of the eighth frame period starts in the drive mode of the fifth horizontal scanning period H8 (see FIG. 11). Hereinafter, driving is performed in an order from the drive mode of the first horizontal scanning period H1 to the drive mode of the seventh horizontal scanning period H7. The gradation distribution of the eighth frame period is shown in the table of FIG. 12H.

As described above, according to the driving method of the electro-optical device 20 of Fourth Exemplary Embodiment, the following effects can be obtained.

(5) According to Fourth Exemplary Embodiment, the order (timing) of supplying the selection signals SEL is changed for each horizontal scanning period H, thus, in each horizontal scanning period and each frame period, the positions of the pixels 21 to which the same image signal D is written can be dispersed, and it is possible to make the deterioration of image quality difficult to be visually recognized.

Modification Examples

Further, the embodiments described above may be modified as follows.

In the embodiments described above, the pre-charge signal PRC is supplied at the same timing at the beginning of each horizontal scanning period H, but the present disclosure is not limited to this, and may be the following aspects.

Figure 13:
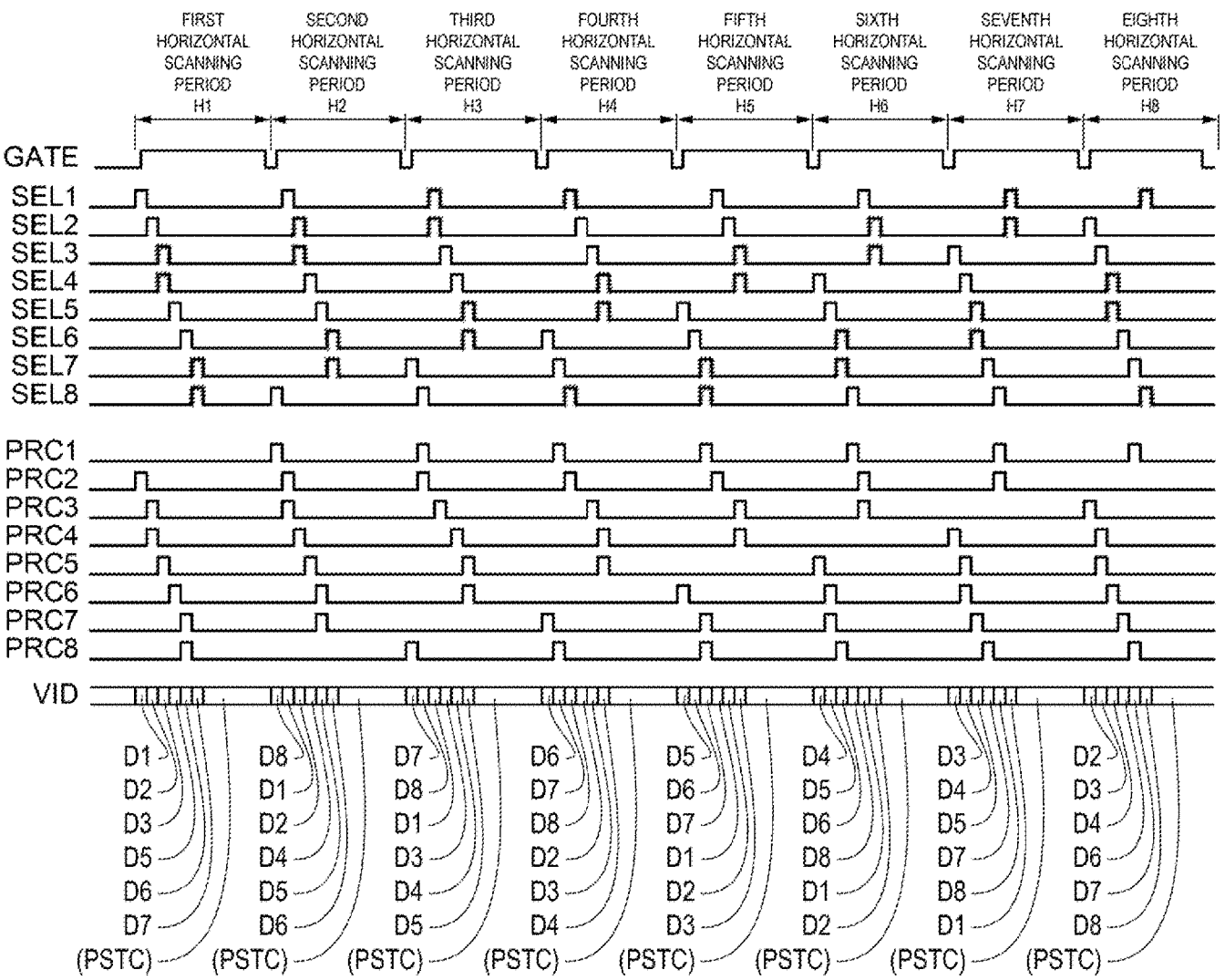
FIG. 13 is a timing chart illustrating a driving method of a modified example.

FIG. 13 is a timing chart illustrating a driving method of a modified example. Note that, the driving method of the modified example is the same as Fourth Exemplary Embodiment except for the operation of supplying the per-charge signal PRC. Therefore, the gradation distribution in each frame period is also the same as that of FIGS. 12A to 12H.

A pre-charge circuit (referred to as a sequential pre-charge circuit in the present modified example) can be used, for example, a known technique, and is disposed in the signal line driving circuit 53 (not illustrated). Specifically, for example, as illustrated in FIG. 13, in the first horizontal scanning period, the second pre-charge signal PRC2 is supplied immediately before the second selection signal SEL2.

Thereafter, the third pre-charge signal PRC3 is supplied immediately before the third selection signal SEL3 is supplied, the fourth pre-charge signal PRC4 is supplied immediately before the fourth selection signal SEL4 is supplied, and then the pre-charge signal PRC is sequentially supplied (sequential pre-charge driving). In this way, by supplying the pre-charge signal PRC immediately before the selection signal SEL is supplied, a dedicated pre-charge period can be reduced and the high speed driving can be accommodated.

Further, in the embodiments described above, the gradation distribution was set such that, the first pixel 12*a* to the eighth pixel 12*h* are sequentially set to be 80 gradations, 100 gradations, 120 gradations, 140 gradations, 160 gradations, 180 gradations, 200 gradations, and 220 gradations, but the gradation distribution is not limited to this, for example, the gradations may be set in which numerical values for each frame period are averaged.

FIG. 14 is a table showing the gradation of a modified example of First Exemplary Embodiment. As illustrated in FIG. 14, in order from the first pixel 21*a* column to the eighth pixel 21*h* column, 77.5 gradations, 97.5 gradations, 118 gradations, 138 gradations, 178 gradations, 178 gradations, and 218 gradations are sequentially set.

Specifically, the gradation for each frame period is an average value. For example, in the first pixel 21*a* column, only the eighth frame period is set to be 60 gradations, thus the gradation is calculated and averaged as (80 gradations×7 frames+60 gradations×1 frame)/8 frames.

Further, as shown in FIG. 15, the gradations may be set to average gradation values in Second Exemplary Embodiment to Fourth Exemplary Embodiment.

Furthermore, in the embodiments described above, the simultaneously selected signal lines 23 are referred to as two adjacent signal lines 23, but the present disclosure is not limited to this, and three or more adjacent signal lines may be simultaneously selected as a set to supply the same image signal D.

In addition, as in Second Exemplary Embodiment to Fourth Exemplary Embodiment, the combination of the simultaneously selected signal lines 23 was made into two sets, but the present disclosure is not limited to this, it may be made into three sets or more.

Further, in the embodiments described above, the configuration of eight selection signals SEL (SEL1 to SEL8) is described, but the present disclosure is not limited to this, the configuration of four selection signals SEL, the configuration of 12 selection signals SEL, or the configuration of 16 selection signals SEL may be used.

Further, in the embodiments described above, the writing polarity to the pixel 21, that is, a positive polarity writing or a negative polarity writing is not mentioned, but may be as follows. For example, when the drive frequency is 240 Hz (four-time speed driving) as described in First Exemplary Embodiment, writing is performed such that the positive polarity writing in the first frame period, the negative polarity writing in the second frame period, the positive polarity writing in the third frame period, and the negative polarity writing in the fourth frame period. In this case, in the second frame period, writing is performed without changing the combination of the two signal lines 23 selected simultaneously. Furthermore, in the fourth frame period, writing is performed without changing the combination of the two signal lines selected simultaneously. The change in the combination of the two signal lines 23 selected simultaneously is performed in the first frame period and the third frame period. When the combination is changed in the second frame period and the fourth frame period, the polarity balance between the positive polarity writing and the negative polarity writing is lost, which causes the occurrence of burn-in or flicker, however, by not changing the combination of the two signal lines 23 simultaneously selected in the second frame period and the fourth frame period, the occurrence of burn-in and flicker can be suppressed.

Further, in First Exemplary Embodiment and Second Exemplary Embodiment, the combination of the signal lines 23 is changed for each frame period, but the following may be used. For example, when the drive frequency is 480 Hz (eight-time speed driving), the combination of the signal lines 23 may be changed every two frame periods or every four frame periods. Furthermore, in the modified example described above, the combination of the signal lines 23 may not be changed in a frame of a set of positive and negative polarities.

Further, in Third Exemplary Embodiment and Fourth Exemplary Embodiment, the combination of signal lines 23 is changed for each horizontal scanning period, but the combination of the signal lines 23 may be changed every plural horizontal scanning periods. In addition, as in First Exemplary Embodiment and Second Exemplary Embodiment, in each frame period, the combination of the signal lines 23 may be changed among the signal line groups.

Contents derived from the exemplary embodiments will be described below.

An electro-optical device includes a plurality of signal lines, a plurality of scanning lines, pixels arranged corresponding to intersections of the plurality of signal lines and the plurality of scanning lines, image signal lines arranged respectively corresponding to k signal lines among the plurality of signal lines, k switches arranged between the image signal lines and the k signal lines respectively, a selection signal output circuit configured to output a selection signal for selecting the k switches, and an image signal output circuit outputting an image signal to the pixels via the image signal lines, wherein the selection signal output circuit outputs a selection signal for simultaneously selecting a set of switches, which correspond to a set of adjacent signal lines, among the k switches in a partial period obtained by time-dividing a horizontal scanning period, and outputs a selection signal for selecting remaining switches among the k switches one at a time in a remaining period of the time-divided horizontal scanning period, and the image signal output circuit supplies a same image signal to a set of adjacent signal lines corresponding to the simultaneously selected set of switches in a partial period obtained by time-dividing the horizontal scanning period.

According to this configuration, a set of switches corresponding to a set of adjacent signal lines among the k switches is simultaneously selected to supply the same image signal, thus, as compared to a case where one signal line is selected to supply the image signal, the selecting period can be shortened by one period. In addition, the adjacent signal lines, in other words, the same image signal is written to a part of the pixels, thus deterioration of the display image can be suppressed. As a result, the time of writing the image signal to the signal line can be secured, and high-resolution display quality can be provided. Specifically, for example, brightness and image quality can be improved by increasing the writing time as much as reducing the number of times of writing. Furthermore, the drive frequency can be increased as much as reducing the number of times of writing, and high resolution and high speed driving can be easily performed.

In the electro-optical device described above, it is desirable that the selection signal output circuit changes, at predetermined time intervals, the combination of the set of switches that are simultaneously selected.

According to this configuration, the combination of the simultaneously selected set of switches is changed at predetermined time intervals, thus deterioration of the image quality can be suppressed.

In the electro-optical device described above, the selection signal output circuit may perform p-time speed driving that supplies the same image signal to the pixels p times for each vertical scanning period, and may change, p times or 2/p times in p vertical scanning periods, a combination of the set of switches that are simultaneously selected.

According to this configuration, the combination of the simultaneously selected set of switches can be changed p times or 2/p times during the p vertical scanning periods, thus pixels to which the same image signal is written can be dispersed in the display screen, and deterioration in display quality can be suppressed.

In the electro-optical device described above, the selection signal output circuit may simultaneously select two sets of switches, which respectively correspond to two sets of adjacent signal lines, among the k switches in a partial time period obtained by time-dividing the horizontal scanning period, and may supply a first image signal to first set of adjacent signal lines corresponding to a first set of switches and also supply a second image signal to a second set of adjacent signal lines corresponding to a second set of switches.

According to this configuration, the first image signal is supplied to the first set of adjacent signal lines corresponding to the first set of switches, and the second image signal is supplied to the second set of adjacent signal lines corresponding to the second set of switches, thus the selecting period can be shortened by two periods. As a result, the time of writing the image signal to the signal line can be secured, and high-resolution display quality can be provided.

In the electro-optical device described above, a vertical scanning period may include a first horizontal scanning period and a second horizontal scanning period, and the selection signal output circuit may change a combination of the set of switches that are simultaneously selected in the first horizontal scanning period and the second horizontal scanning period.

According to this configuration, the combination of the simultaneously selected set of switches is changed between the first horizontal scanning period and the second horizontal scanning period, thus, pixels to which the same image signal is written can be dispersed. As a result, deterioration in display quality can be suppressed.

In the electro-optical device described above, the selection signal output circuit may supply an image signal, which is to be supplied to any one signal line of the set of adjacent signal lines corresponding to the set of switches that are simultaneously selected, to also the other signal line of the set of adjacent signal lines corresponding to the set of switches that are simultaneously selected.

According to this configuration, the image signal to be supplied to the signal line of any one of a set of adjacent signal lines corresponding to the simultaneously selected set of switches can be supplied to the other signal lines of the set of adjacent signal lines corresponding to the simultaneously selected set of switches, thus the selecting period can be shortened, and the writing time can be secured.

In the electro-optical device described above, the image signal output circuit may supply an image signal, which is obtained by averaging image signals in a plurality of vertical scanning periods, to a set of adjacent signal lines corresponding to the set of switches that are simultaneously selected.

According to this configuration, the same image signal is supplied in accordance with the averaged image signal, thus changes in gradation can be suppressed, and deterioration in the image can be suppressed.

There is a driving method for an electro-optical device that includes a plurality of signal lines, a plurality of scanning lines, pixels arranged corresponding to intersections of the plurality of signal lines and the plurality of scanning lines, image signal lines arranged respectively corresponding to k signal lines among the plurality of signal lines, k switches arranged between the image signal lines and the k signal lines respectively, a selection signal output circuit configured to output a selection signal for selecting the k switches, and an image signal output circuit configured to output an image signal to the pixels via the image signal lines, the driving method including outputting by the selection signal output circuit a selection signal for simultaneously selecting a set of switches, which correspond to a set of adjacent signal lines, among the k switches in a partial period obtained by time-dividing a horizontal scanning period, and outputting a selection signal for selecting remaining switches among the k switches one at a time in a remaining period of the time-divided horizontal scanning period; and supplying by the image signal output circuit a same image signal to a set of adjacent signal lines corresponding to the set of switches that are simultaneously selected in a partial period obtained by time-dividing the horizontal scanning period.

According to this method, a set of switches corresponding to a set of adjacent signal lines among the k switches is simultaneously selected to supply the same image signal, thus, as compared to a case where one signal line is selected to supply the image signal, the selecting period can be shortened by one period. In addition, the adjacent signal lines, in other words, the same image signal is written to a part of the pixels, thus deterioration of the display image can be suppressed. As a result, the time of writing the image signal to the signal line can be secured, and high-resolution display quality can be provided. Specifically, for example, brightness and image quality can be improved by increasing the writing time as much as reducing the number of times of writing. Furthermore, the drive frequency can be increased as much as reducing the number of times of writing, and high resolution and high speed driving can be easily performed.

In the driving method for the electro-optical device described above, the selection signal output circuit may change, at predetermined time intervals, a combination of the set of switches that are simultaneously selected.

According to this method, the combination of the simultaneously selected set of switches is changed at predetermined time intervals, thus deterioration of the image quality can be suppressed.

In the driving method for the electro-optical device described above, the selection signal output circuit may perform p-time speed driving that supplies the same image signal to the pixels p times for each vertical scanning period, and may change, p times or 2/p times in p vertical scanning periods, a combination of the set of switches that are simultaneously selected.

According to this method, the combination of the simultaneously selected set of switches can be changed p times or 2/p times during the p vertical scanning periods, thus pixels to which the same image signal is written can be dispersed in the display screen, and deterioration in display quality can be suppressed.

In the driving method for the electro-optical device described above, the selection signal output circuit may simultaneously select two sets of switches, which respectively correspond to two sets of adjacent signal lines, among the k switches in a partial time period obtained by time-dividing the horizontal scanning period, and may supply a first image signal to a first set of adjacent signal lines corresponding to a first set of switches and also supply a second image signal to a second set of adjacent signal lines corresponding to a second set of switches.

According to this method, the first image signal is supplied to the first set of adjacent signal lines corresponding to the first set of switches, and the second image signal is supplied to the second set of adjacent signal lines corresponding to the second set of switches, thus the selecting period can be shortened by two periods. As a result, the time of writing the image signal to the signal line can be secured, and high-resolution display quality can be provided.

In the driving method for the electro-optical device described above, a vertical scanning period may include a first horizontal scanning period and a second horizontal scanning period, and the selection signal output circuit changes a combination of the set of switches that are simultaneously selected in the first horizontal scanning period and the second horizontal scanning period.

According to this method, the combination of the simultaneously selected set of switches is changed between the first horizontal scanning period and the second horizontal scanning period, thus, pixels to which the same image signal is written can be dispersed. As a result, deterioration in display quality can be suppressed.

In the driving method for the electro-optical device described above, the selection signal output circuit may supply an image signal, which is to be supplied to any one signal line of a set of adjacent signal lines corresponding to the set of switches that are simultaneously selected, to also the other signal line of a set of adjacent signal lines corresponding to the set of switches that are simultaneously selected.

According to this method, the image signal to be supplied to the signal line of any one of a set of adjacent signal lines corresponding to the simultaneous selected set of switches can be supplied to the other signal lines of the set of adjacent signal lines corresponding to the simultaneously selected set of switches, thus the selecting period can be shortened, and the writing time can be secured.

In the driving method for the electro-optical device described above, the image signal output circuit may supply an image signal, which is obtained by averaging image signals in a plurality of vertical scanning periods, to a set of adjacent signal lines corresponding to the set of switches that are simultaneously selected.

According to this method, the same image signal is supplied in accordance with the averaged image signal, thus changes in gradation can be suppressed, and deterioration in the image can be suppressed.

An electronic apparatus includes the electro-optical device described above.

According to this configuration, an electronic apparatus capable of obtaining high-resolution display quality can be provided.

What is claimed is:

1. An electro-optical device, comprising:

a plurality of signal lines;

a plurality of scanning lines;

pixels arranged corresponding to intersections of the plurality of signal lines and the plurality of scanning lines;

image signal lines arranged respectively corresponding to k signal lines among the plurality of signal lines;

k switches arranged between the image signal lines and the k signal lines, respectively, where k is an integer not less than two;

a selection signal output circuit configured to:

output a selection signal for selecting the k switches;

output a selection signal for simultaneously selecting a set of switches, which correspond to a set of adjacent signal lines, among the k switches in a partial period obtained by time-dividing a horizontal scanning period;

output a selection signal for selecting remaining switches among the k switches one at a time in a remaining period of the time-divided horizontal scanning period; and change, at predetermined time intervals, a combination of the set of switches that are simultaneously selected; and simultaneously select different combinations of the set of switches at different times; and an image signal output circuit configured to:

output an image signal to the pixels via the image signal lines; and supply a same image signal to a set of adjacent signal lines corresponding to the simultaneously selected set of switches in a partial period obtained by time-dividing the horizontal scanning period.

2. The electro-optical device according to claim 1, wherein the selection signal output circuit performs speed driving that supplies a same image signal to the pixels p times for each vertical scanning period, and changes, p times or 2/p times, a combination of the set of switches that are simultaneously selected, where p is a number of vertical scanning periods.

3. The electro-optical device according to claim 1, wherein the selection signal output circuit simultaneously selects two sets of switches, which respectively correspond to two sets of adjacent signal lines, among the k switches in a partial time period obtained by time-dividing the horizontal scanning period, and supplies a first image signal to a first set of adjacent signal lines corresponding to a first set of switches and also supplies a second image signal to a second set of adjacent signal lines corresponding to a second set of switches.

4. The electro-optical device according to claim 1, wherein a vertical scanning period includes a first horizontal scanning period and a second horizontal scanning period, and the selection signal output circuit changes a combination of the set of switches that are simultaneously selected in the first horizontal scanning period and the second horizontal scanning period.

5. The electro-optical device according to claim 1, wherein the selection signal output circuit supplies an image signal, which is to be supplied to any one signal line of the set of adjacent signal lines corresponding to the set of switches that are simultaneously selected, to also the other signal line of the set of adjacent signal lines corresponding to the set of switches that are simultaneously selected.

6. The electro-optical device according to claim 1, wherein the image signal output circuit supplies an image signal, which is obtained by averaging image signals in a plurality of vertical scanning periods, to a set of adjacent signal lines corresponding to the set of switches that are simultaneously selected.

7. An electronic apparatus comprising the electro-optical device according to claim 1.

8. A driving method for an electro-optical device, the electro-optical device including: a plurality of signal lines; a plurality of scanning lines; pixels arranged corresponding to intersections of the plurality of signal lines and the plurality of scanning lines; image signal lines arranged respectively corresponding to k signal lines among the plurality of signal lines; k switches arranged between the image signal lines and the k signal lines, respectively, where k is an integer not less than two; a selection signal output circuit configured to output a selection signal for selecting the k switches; and an image signal output circuit configured to output an image signal to the pixels via the image signal lines, the driving method comprising:

outputting, by the selection signal output circuit, a selection signal for simultaneously selecting a set of switches, which correspond to a set of adjacent signal lines, among the k switches in a partial period obtained by time-dividing a horizontal scanning period, and outputting a selection signal for selecting remaining switches among the k switches one at a time in a remaining period of the time-divided horizontal scanning period;

changing at predetermined time intervals, by the selection signal output circuit, a combination of the set of switches that are simultaneously selected;

simultaneously selecting different combinations of the set of switches at different times, by the selection signal output circuit; and supplying, by the image signal output circuit, a same image signal to a set of adjacent signal lines corresponding to the set of switches that are simultaneously selected in a partial period obtained by time-dividing the horizontal scanning period.

9. The driving method for an electro-optical device according to claim 8, wherein the selection signal output circuit performs speed driving that supplies a same image signal to the pixels p times for each vertical scanning period, and changes, p times or 2/p times, a combination of the set of switches that are simultaneously selected, where p is a number of vertical scanning periods.

10. The driving method for an electro-optical device according to claim 8, wherein the selection signal output circuit simultaneously selects two sets of switches, which respectively correspond to two sets of adjacent signal lines, among the k switches in a partial time period obtained by time-dividing the horizontal scanning period, and supplies a first image signal to a first set of adjacent signal lines corresponding to a first set of switches and also supplies a second image signal to a second set of adjacent signal lines corresponding to a second set of switches.

11. The driving method for an electro-optical device according to claim 8, wherein a vertical scanning period includes a first horizontal scanning period and a second horizontal scanning period, and the selection signal output circuit changes a combination of the set of switches that are simultaneously selected in the first horizontal scanning period and the second horizontal scanning period.

12. The driving method for an electro-optical device according to claim 8, wherein the selection signal output circuit supplies an image signal, which is to be supplied to any one signal line of a set of adjacent signal lines corresponding to the set of switches that are simultaneously selected, to also the other signal line of the set of adjacent signal lines corresponding to the set of switches that are simultaneously selected.

13. The driving method for an electro-optical device according to claim 8, wherein the image signal output circuit supplies an image signal, which is obtained by averaging image signals in a plurality of vertical scanning periods, to a set of adjacent signal lines corresponding to the set of switches that are simultaneously selected.

* * * * *